US005869782A

United States Patent [19]

Shishido et al.

[11] Patent Number: 5,869,782

[45] Date of Patent: Feb. 9, 1999

[54] MUSICAL DATA PROCESSING WITH LOW TRANSMISSION RATE AND STORAGE CAPACITY

[75] Inventors: Ichiro Shishido, Zushi; Toshio Kuroiwa, Yokohama, both of Japan

[73] Assignee: Victor Company of Japan, Ltd., Yokohama, Japan

[21] Appl. No.: 741,123

[22] Filed: Oct. 30, 1996

[30] Foreign Application Priority Data

Oct. 30, 1995 [JP] Japan ..... 7-306780
Nov. 11, 1995 [JP] Japan ..... 7-317535

[51] Int. Cl.[6] ..... G10H 1/02; G10H 1/26

[52] U.S. Cl. ..... 84/609; 84/626

[58] Field of Search ..... 84/602, 609–614, 84/626–633; 341/51

[56] References Cited

U.S. PATENT DOCUMENTS

| | | | |
|---|---|---|---|
| 3,955,459 | 5/1976 | Mochida et al. | 84/609 |
| 4,681,007 | 7/1987 | Nikaido et al. | 84/626 |
| 5,229,533 | 7/1993 | Sakurai | 84/633 X |
| 5,262,584 | 11/1993 | Shimada | 84/609 |
| 5,262,776 | 11/1993 | Kutka | 341/51 |
| 5,386,081 | 1/1995 | Nakada et al. | 84/609 |
| 5,436,404 | 7/1995 | Shimada | 84/610 |
| 5,489,746 | 2/1996 | Suzuki et al. | 84/602 |
| 5,518,408 | 5/1996 | Kawashima et al. | 84/609 X |
| 5,576,506 | 11/1996 | Kawashima et al. | 84/602 |

*Primary Examiner*—Stanley J. Witkowski
*Attorney, Agent, or Firm*—Jacobson, Price, Holman & Stern, PLLC

[57] ABSTRACT

Each musical performance data of a source file includes time data, note data indicative of music sound start or music sound stop at a moment indicated by the time data, and accent data indicative of sound velocity. The time data, the note, and either the music sound start or the music sound stop are recorded in a first recording area in accordance with the time data. The accent data is recorded in a second recording area. The second recording area is separated from the first recording area. The recorded data in the first and second areas are combined to obtain a target file. And, the another file is recorded in a recording medium. A reproducing apparatus reproduces the recorded musical performance data. The musical performance data are decoded and temporarily stored into a storage medium. The decoded and temporarily stored data are controlled such that the note and accent data are reproduced before the control data. A sound source reproduces the controlled musical performance data and generates music sounds in accordance with the reproduced data.

11 Claims, 32 Drawing Sheets

(DT, A, B, C)

⇩

(0, ON, DO, 40)

(8, OF, DO, 64)

(2, ON, RE, 45)

(8, OF, RE, 64)

(2, ON, MI, 50)

(8, OF, MI, 64)

(2, ON, DO, 55)

(8, OF, DO, 64)

(2, ON, RE, 60)

(8, OF, RE, 64)

(2, ON, MI, 65)

(8, OF, MI, 64)

(2, ON, DO, 70)

(8, OF, DO, 64)

(2, ON, RE, 75)

(8, OF, RE, 64)

(2, ON, MI, 80)

(8, OF, MI, 64)

FIG.1

( DT, A, B, C )
⇩
( 0, CL, EX, 40 )
( 0, ON, DO, 64 )
( 8, OF, DO, 64 )
( 0, CL, EX, 45 )
( 2, ON, RE, 64 )
( 8, OF, RE, 64 )
( 0, CL, EX, 50 )
( 2, ON, MI, 64 )
( 8, OF, MI, 64 )
( 0, CL, EX, 55 )
( 2, ON, DO, 64 )
( 8, OF, DO, 64 )
( 0, CL, EX, 60 )
( 2, ON, RE, 64 )
( 8, OF, RE, 64 )
( 0, CL, EX, 65 )
( 2, ON, MI, 64 )
( 8, OF, MI, 64 )
( 0, CL, EX, 70 )
( 2, ON, DO, 64 )
( 8, OF, DO, 64 )
( 0, CL, EX, 75 )
( 2, ON, RE, 64 )
( 8, OF, RE, 64 )
( 0, CL, EX, 80 )
( 2, ON, MI, 64 )
( 8, OF, MI, 64 )

CHANNEL MAP

| TRACK | CHANNEL NUMBER |
|---|---|
| 1 | 2 |
| 2 | 3 |
| 3 | 5 |
| 4 | 1 |

FIG.16

NOTE TABLE

| | TIME | NOTE NO. | VELOCITY | DURATION | SEE NOTE-OFF | ΔT |
|---|---|---|---|---|---|---|
| NOTE 1 | 480 | 60 | 80 | 240 | 1 | |
| NOTE 2 | 640 | 62 | 80 | | 0 | |
| | | | | | | |
| NOTE NA | | | | | | |

FIG.18

CONTROLLER TABLE

| | TIME | DATA | ΔT |
|---|---|---|---|
| EVENT 1 | | | |
| EVENT 2 | | | |
| | | | |
| EVENT NB | | | |

FIG.19

NOTE △CODE

| |
|---|
| △Ts |
| △Ta [ 1 ] |
| △Ta [ 2 ] |
| |
| △Ta [ NA ] |

FIG.21

CONTINUOUS EVENT BLOCK

| △TIME | STATUS | PARAMETER |
|---|---|---|
| 10 | 224(PITCH WHEEL CHANGE) | 8192 |
| 20 | 224(PITCH WHEEL CHANGE) | 8193 |
| 20 | 224(PITCH WHEEL CHANGE) | 8194 |
| 10 | 224(PITCH WHEEL CHANGE) | 8195 |
| 30 | 224(PITCH WHEEL CHANGE) | 8196 |
| 10 | 224(PITCH WHEEL CHANGE) | 8197 |
| 20 | 224(PITCH WHEEL CHANGE) | 8198 |

CONTINUOUS EVENT CODE

CONTROLLER CODE

| |
|---|
| FLAG F |
| INITIAL VALUE "8192" |
| REMAINDER "1" |
| REMAINDER "1" |
| REMAINDER "1" |
| REMAINDER "1" |
| REMAINDER "1" |
| REMAINDER "1" |

FIG.29

NOTE-ON EVENT

| △TIME | STATUS (9x hex) | NOTE No. | VELOCITY |
|---|---|---|---|

NOTE-OFF QUEUE

| | Toff | NOTE No. |
|---|---|---|
| ENTRY 1 | 1000 | 64 |
| ENTRY 2 | 1100 | 54 |

CONTROLLER EVENT DECODING PROCESSING

CONTROLLER EVENT

| △TIME | STATUS | PARAMETER |
|---|---|---|

FIG.39

MUSICAL DATA PROCESSING WITH LOW TRANSMISSION RATE AND STORAGE CAPACITY

BACKGROUND OF THE INVENTION

The present invention relates to a musical data recording method and reproducing apparatus, which can reduce the transmission rate and the storage capacity of digitalized musical performance data when the same data are transmitted and further when the transmitted data are stored in a storage medium.

In general, MIDIs (musical instrument digital interfaces) are widely used as transmitting means of musical performance data for playing music. Here, the MIDI is an industrial standard prescribed for hardware and software connected to a sound source apparatus (e.g., synthesizer, electronic piano, etc.) in order to use various musical performance data interchangeably. In more detail, when the MIDI is used, the musical data inputted by a player through a keyboard are converted into MIDI data, and then outputted through a transmission path. On the other hand, a sound source apparatus is provided with such functions as to receive the MIDI data and to generate musical sound actually. Therefore, when the sound source apparatus is connected to the transmission path, the received MIDI data can be interpreted to generate musical sound.

The above-mentioned MIDI data are roughly composed of the following data:

(1) Musical note data (referred to as note data, hereinafter) indicative of sound starts by key touch (a key is depressed) or sound stops by key release (a key is not depressed). Further, the note data include data indicative of sound pitches (note numbers) designated by key numbers.

(2) Accent data indicative of sound velocity, which are transmitted or received in accompany with note data in the case of the MIDI.

(3) Control data for transmitting intonation representations (i.e., crescendo, musical fluctuations of the note number) to the sound source apparatus. In practice, when a player uses a pedal or a lever, since the change of the lever position is detected by a MIDI converter disposed on the player side, the lever position data are transmitted.

Further, since these musical performance data are transmitted instantaneously in progress of musical performance, the musical performance data stream includes the above-mentioned data under mixed condition.

Here, since all the MIDI data are digitalized, the data can be recorded, edited, and reproduced by use of a computer apparatus (e.g., synthesizer) and a storage medium. In other words, the MIDI data can be stored in a storage medium as a data file. Here, SMF (standard MIDI file) is widely used as a format of the data file. However, since the MIDI data are actual time data, when the respective data elements (referred to as MIDI events, hereinafter) such as the sound starts or sound stops are recorded in the SMF, the MIDI data are recorded under such conditions that time data are attached to the MIDI data, respectively. Further, since recorded in the order of the generation of the MIDI events, the note data and the control data are both recorded in a mixed form.

By the way, without being limited only to the SMF, when the data file is stored, since there exists a limit of the capacity of the storage medium, it is preferable that data are compressed. Therefore, in the case when the MIDI data are compressed, in general, there has been so far used a compression technique based upon the pattern matching referred to as LZ (Lempel-zif) method adopted under a program such as LHA or ZIP. The principle of this data compression will be simply explained hereinbelow.

When a compressed file is formed on the basis of an original file, the processed position in the original file is shifted beginning from a file head, and data read from the processing position are copied on the compressed file. Here, when there exist two same data areas in the original file, at a time point when the processing position reaches the head of the second data area of the two same data areas, the data are not simply copied. Instead, a distance from a head position of the first data area to the processing position and a length of the matched data area are both recorded in the compression file. Further, the processing position in the original file is shifted to an end of the second data area, thus continuing the processing. By doing this, data in the second data area are not copied. Instead, only the data length and data distance are added to compress the data.

As understood by the above-mentioned description, in this compression method, the compression ratio increases with increasing data area in which the two same data exist. Further, when a data pattern existing after a processing position is searched on the basis of the data area existing before the processing position, the compression ratio can be increased when the two same data areas exist adjacent to each other. This is due to a limit of the size of the area to be searched.

As an example of the apparatus which uses the musical performance data file such as the SMF, there exists a communication accompanying apparatus (KARAOKE in Japanese, which implies non-orchestra). In the case of the communication accompanying apparatus of non-storage type, a MIDI musical performance data file transmitted from a distributing center through a public line is received by a terminal device, and the received data file is reproduced by the terminal device as the accompaniment to a music or a song. Therefore, whenever a user select a song, the musical data related to a selected music is transmitted from the center side. In this case, when the musical performance data file are compressed on the distributing center and then transmitted, since the transmission time can be shortened and therefore economized, it is possible to reduce the rental fee of the transmission line.

Further, in the case of the terminal device of the communication accompanying apparatus of storage type, a storage medium of large capacity (e.g., hard disc) is incorporated therein, and the musical performance data files transmitted in the past are stored so as to be updated. In this case, when the musical performance data files are stored under compressed conditions, there exists an advantage such that it is possible to store a great number of various songs on the storage medium.

On the other hand, in the above-mentioned music accompanying apparatus of storage type, in order to satisfy various music requests of the users, it is necessary to store as many songs as possible in the limited storage medium. Therefore, it is preferable that the music data file data are compressed. In the case of the music data file such as the SMF, a relatively high compression ratio can be obtained, as compared with the ordinary text file. This is because in the case of the musical performance data, the same data are often recorded repeatedly from the nature thereof.

Recently, however, since the user's requests are diversified more and more, there exists a need of storing still large number of songs. Here, when the capacity of the storage medium is simply increased, the cost of the storage medium not only increases, but also the rental fee of the transmission line increases due to an increase of the number of songs to be distributed from the center.

To overcome this problem, it may be possible to reduce the data quantity and the distribution cost by simply reducing the music performance data so that musical data file of less data capacity can be transmitted. In this case, however, since the quality of the musical performance deteriorates markedly, this method is not a practical method. As a result, there exists a need of reducing the data quantity and the transmission cost of the musical performance data file, without deteriorating the quality of musical performance data.

SUMMARY OF THE INVENTION

An object of the present invention is to provide a method of recording musical data at high data compression without deterioration of the musical data and an apparatus for reproducing the recorded musical data by the method.

The present invention provides a method of recording a file of sequential musical performance data each including time data, note data indicative of a note and music sound start or music sound stop of the note at a moment indicated by the time data, and accent data indicative of sound velocity, comprising the steps of: sequentially reading the musical performance data; recording the time data, the note, and either the music sound start or the music sound stop in a first recording area in accordance with the time data; recording the accent data in a second recording area, the second recording area being separated from the first recording area; combining the recorded data in the first and second areas to obtain another file; and recording the another file in a recording medium.

The file may consist of a plurality of musical performance data each including the time, note, and accent data, and another plurality of musical performance data each including control data. In this case, the method further comprises the steps of: judging whether the musical performance data thus read includes the note data; when the judging is made, recording the time data, note data, and either the music sound start or the music sound stop in the first recording area, and the accent data in the second recording area; when the judging is not made, recording the control data in a third recording area, the third recording area being separated from the first and second recording areas; and combining the recorded data in the first, second, and third areas to obtain the another file.

Further, the present invention provides an apparatus for reproducing compressed sequential musical performance data, comprising: decoding means for decoding the compressed sequential musical performance data stored in a first storage medium, the sequential musical performance data including a plurality of time data, a plurality of note data each indicative of music sound start and music sound stop at a moment indicated by the time data, a plurality of accent data each indicative of sound velocity, and a plurality of control data each indicative of intonation, the plurality of note, accent, and control data being recorded in a first, a second, and a third recording area separated from each other in the first storage medium; a second storage medium that temporarily stores the decoded sequential musical performance data; control means for controlling reproduction of the decoded sequential musical performance data temporarily stored in the second storage medium such that the plurality of note and accent data are reproduced before the plurality of control data; and a sound source that reproduces the sequential musical performance data thus controlled by the control means and generates music sounds in accordance with the reproduced sequential musical performance data.

Further, the present invention provides an apparatus for compressing sequential musical performance data, comprising: separating means for separating the musical performance data into at least note number data, sound velocity data, sound duration data, and control data; and compressing means for compressing each of the separated data to form compressed musical performance data.

Further, the present invention provides an apparatus for decoding the compressed musical performance data, comprising: first decoding means for decoding the musical performance data compressed by the Lempel-Zif method; and second decoding means for decoding the musical performance data thus decoded by the first decoding means to reproduce at least note number data, sound velocity data, sound duration data, and control data.

BRIEF DESCRIPTION OF THE DRAWINGS

FIG. 1 is an illustration showing an example of the description of the MIDI events having time data;

FIG. 16 is an illustration showing a channel map formed by the channel separator shown in FIG. 15;

FIG. 18 is an illustration showing a note table formed by the analyzer shown in FIG. 15;

FIG. 19 is an illustration showing a controller table formed by the analyzer shown in FIG. 15;

FIG. 21 is an illustration showing the note Δcodes formed by the note Δcode generator shown in FIG. 15;

FIG. 29 is an illustration showing the effect of the continuous event codes shown in FIG. 28;

FIG. 39 is an illustration showing the controller event decoded by the processing shown in FIG. 38.

DETAILED DESCRIPTION OF THE PREFERRED EMBODIMENTS

Embodiments of the musical performance data recording method and the musical performance data reproducing apparatus according to the present invention will be described hereinbelow with reference to the attached drawings.

The feature of the method according to the present invention is as follows: in the case where the musical performance data including note data indicative of music sound start and stop mixed with at least one of accent data indicative of sound velocity and control data indicative of intonation are recorded, the note data, accent data, and control data are collected separately and then recorded in different areas, independently. The reason why musical data are recorded at different areas according to the sorts of musical data is as follows:

From the standpoint of the nature of music, the data patterns of note data often match each other at music portions when a melody is repeated; on the other hand, the data patterns of accent data and the control data do not necessarily match each other at music portions when the melody is repeated.

An example of musical performance data will be explained with reference to FIG. 1, in which time data, note data and accent data are expressed, without expressing control data for brevity. In this example, the events (data elements) of the MIDI (musical instrument digital interface) are described.

An example of musical performance data, FIG. 1 shows [do, re, mi, do, re, mi, do, re, mi], whose sound volumes increase gradually. In the SMF (standard music MIDI file), the MIDI events having time data as shown in FIG. 1 are to be recorded in a file in series.

Here, when the general description of the musical data is represented as (DT, A, B, C), the DT is event time data indicative of a relative time to the preceding event.

Further, (A, B, C) are the MIDI events, each of whose meaning is as follows:

A: identification data indicative of sort of the MIDI events

ON: sound start event

OFF: sound stop event

When the above code A is a sound start event or a sound stop event, the contents of the codes B and C are as follows:

B: key board number (note number)

C: accent (sound volume) data. An increase of the numerical value C implies that a key is depressed strongly. Further, the accent data for sound stop event is meaningless, so that a fixed value is recorded.

Further, DT, A and B constitute the note data.

In the above example, the recorded musical data are recorded in such a way the time interval of each sound of [do, re, mi, do, re, mi, do, re, mi] is time 10; the sound duration (note duration) is 8; and the accent (sound volume) increases from 40 to 80 gradually.

Figure 2:
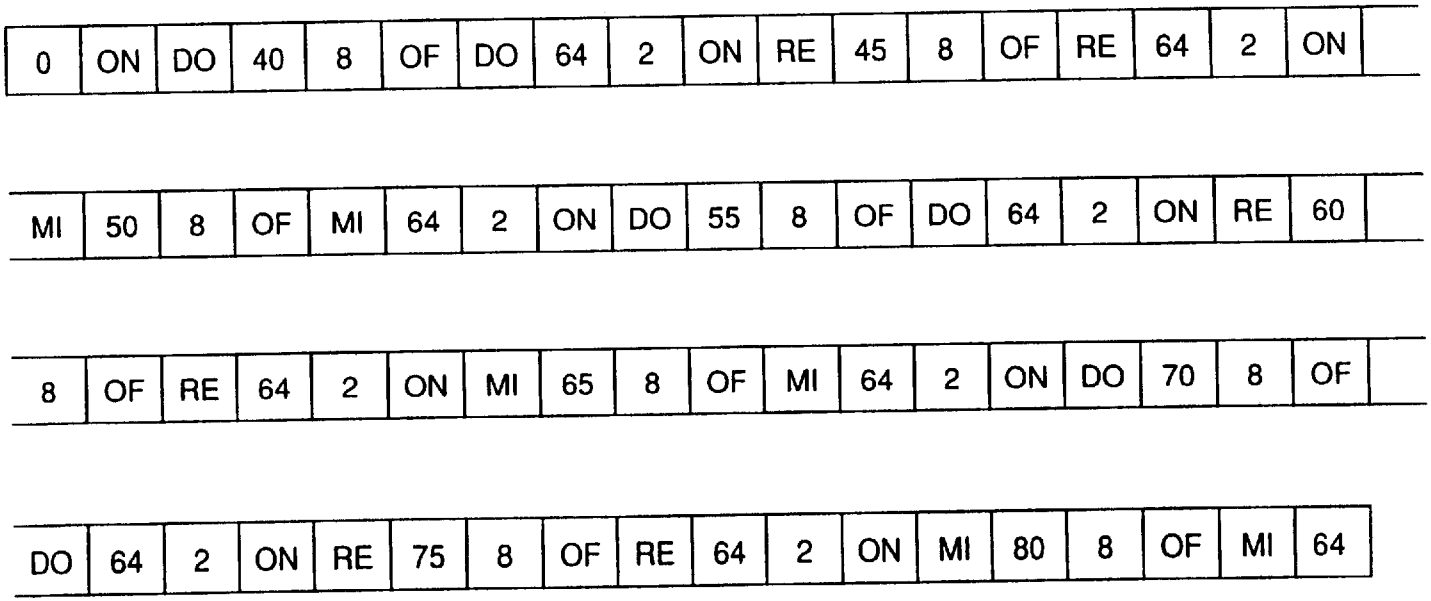
FIG. 2 is an illustration showing a data string obtained when the events shown in FIG. 1 are described in the SMF actually.

FIG. 2 shows an actual data string in the SMF, in which data are recorded in the direction from the upper stage data string to the lower stage data string. In other words, the MIDI event data having time data as shown in FIG. 1 are simply recorded in time series in the order of the events, in which the note data and the accent data are recorded being mixed with each other. In this example, since the generation rate of the same data pattern is very low, the data compression efficiency is very low.

Figure 3:
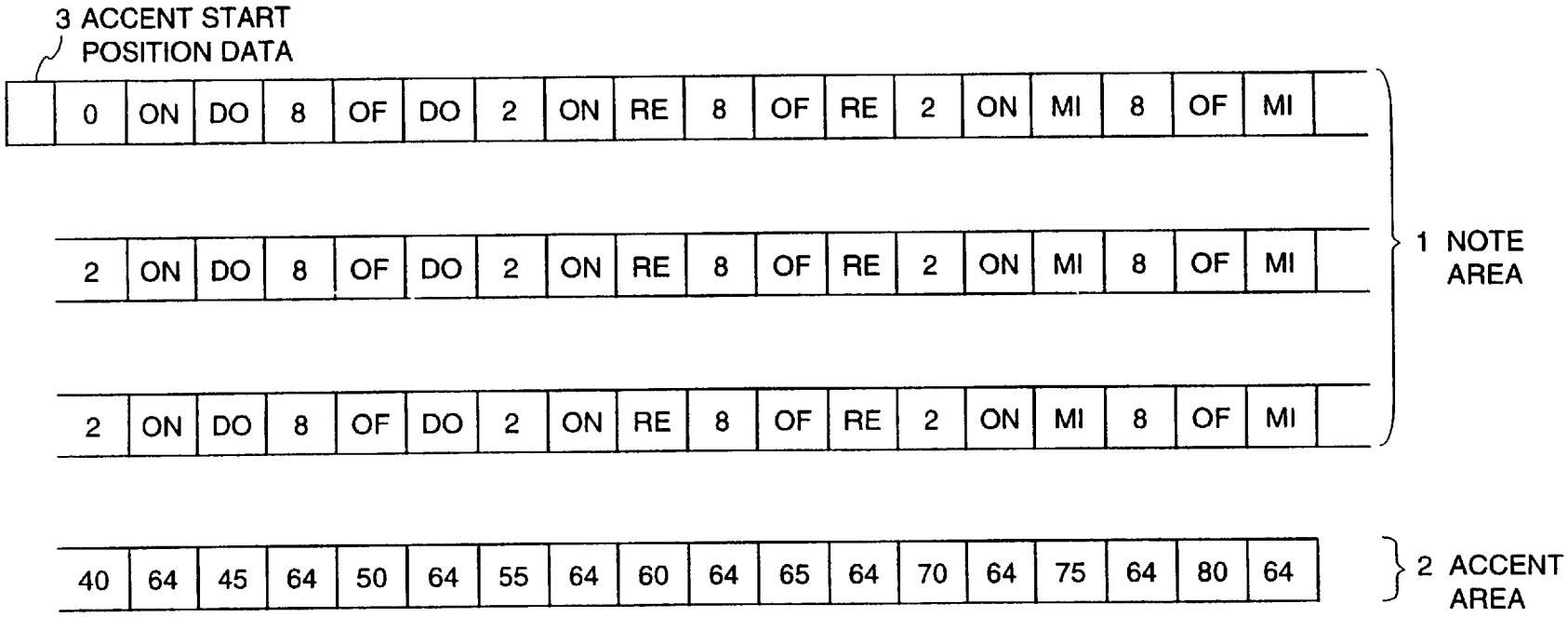
FIG. 3 is an illustration showing a data string obtained when the events are described in accordance of the first embodiment according to the present invention.
Figures 4, 5:
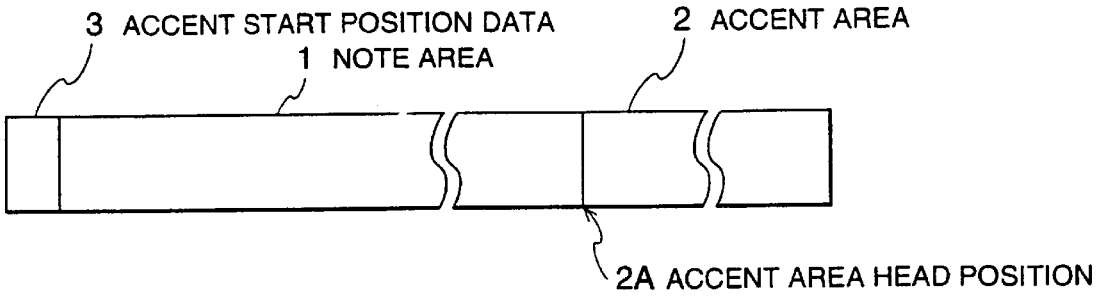
FIG. 4 is an illustration showing the data string shown in FIG. 3 in a more abstract form.
FIG. 5 is an illustration showing an example of the description of the MIDI events, in which the musical performance data similar to the first embodiment are formatted in accordance with another representation method.

In the present invention, therefore, the MIDI event data having time data are recorded at areas different according to the sort of the data, ass shown in FIG. 3. In FIG. 3, first the accent data are taken out of the event data each having time data, and only the note data are recorded in time series. After that, the accent data are recorded after the invent data in such a way that both the recording areas can be separated from each other. In more detail, the front stage is the note area 1 where the not data are recorded; and the succeeding rear stage is the accent area 2 where the accent data are recorded. FIG. 4 shows the division of these areas in more abstract way. In this case, the boundaries between the two areas can be discriminated from each other by recording data related to the head position 2A of the accent area 2 for recording the accent data, as the accent start position data 3, at the head area of the entire file.

When the data string as described above is compressed in accordance with the compression method based upon the pattern matching, it is possible to improve the data compression efficiency markedly, as compared with when the SMF is simply compressed. This is because the note data area 1 is the same data pattern in both data size and data length.

In the case of the example shown in FIG. 3, the pattern from the first [ON] of the first string to the last [mi] of the same string is the same as the pattern from the first [ON] of the second string to the last [mi] of the same string and the pattern from the first [ON] of the third string to the last [mi] of the same string, respectively, so that these strings can be compressed.

In the first embodiment, although the musical data not including the control data have been explained, the recording method of the musical data including the control data will be described hereinbelow as a second embodiment.

In the MIDI events shown in FIG. 5, the musical data are recorded in such a way that although the depression strength of the keyboard is constant, the sound volume control lever is moved immediately after the performance starts to increase the sound volume gradually.

Here, in the same way as with the case of the first embodiment, when the general description of the musical data is represented as (DT, A, B, C), the DT is event time data indicative of a relative time to the preceding event.

Further, (A, B, C) are the MIDI events, each of whose meaning is as follows:

A: identification data indicative of sort of the MIDI events

CL: control event. When A is the control event, B and C are as follows:

B: identification data indicative of the control sort

EX: sound volume control

C: sound volume data

That is, when A is the control event, (DT, A, B, C) are all the control data.

Figure 6:
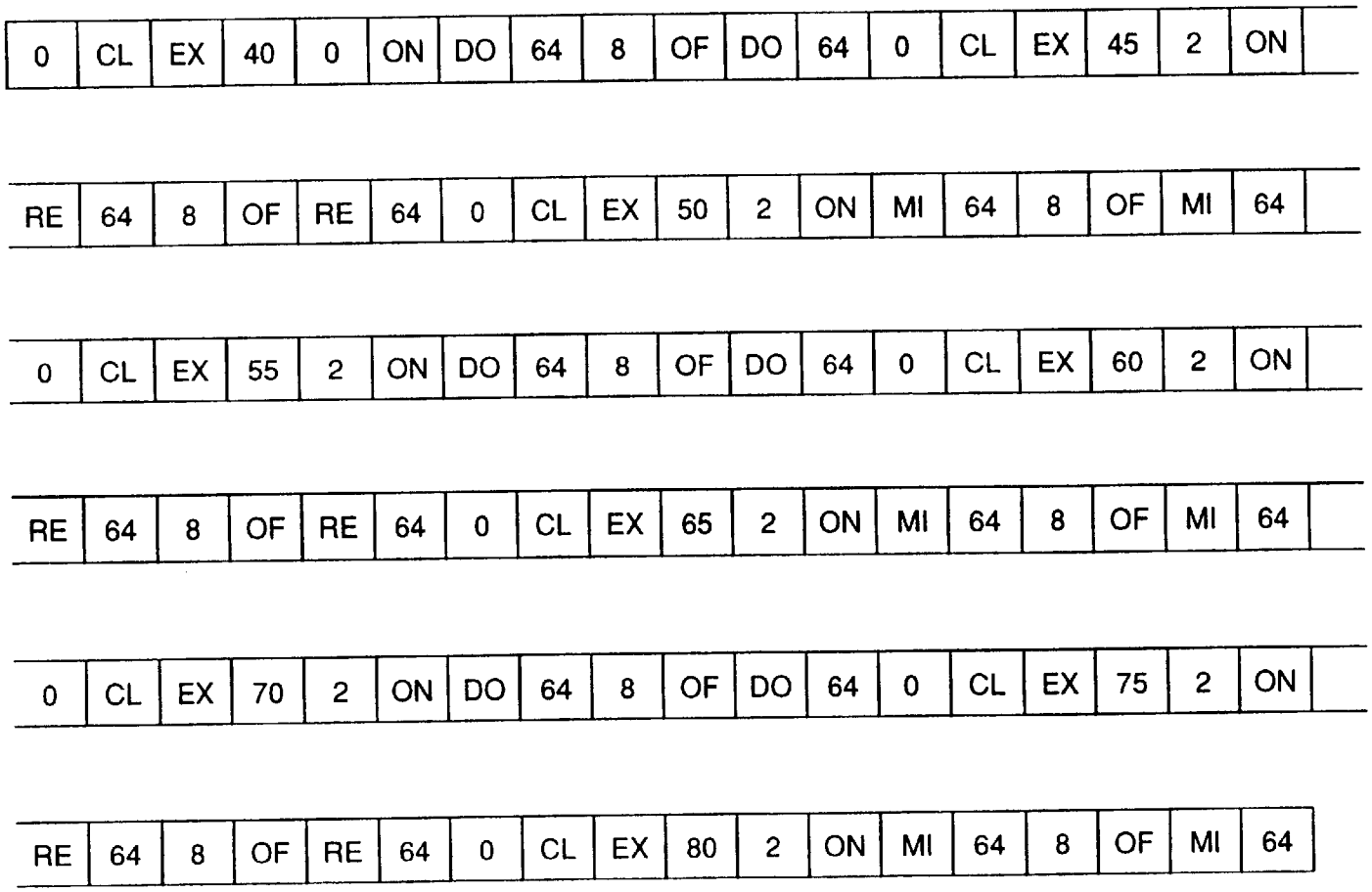
FIG. 6 is an illustration showing a data string obtained when the events shown in FIG. 5 are described in the SMF actually.

FIG. 6 shows an actual data string in the SMF, in which data are recorded in order from the upper stage data string to the lower stage data string. In other words, the MIDI event data having time data as shown in FIG. 5 are simply recorded in time series in the order of the events, in which the accent data and the control data are recorded being mixed with each other. In this example, since the generation rate of the same data pattern is very low, the data compression efficiency is very low.

Figure 7:
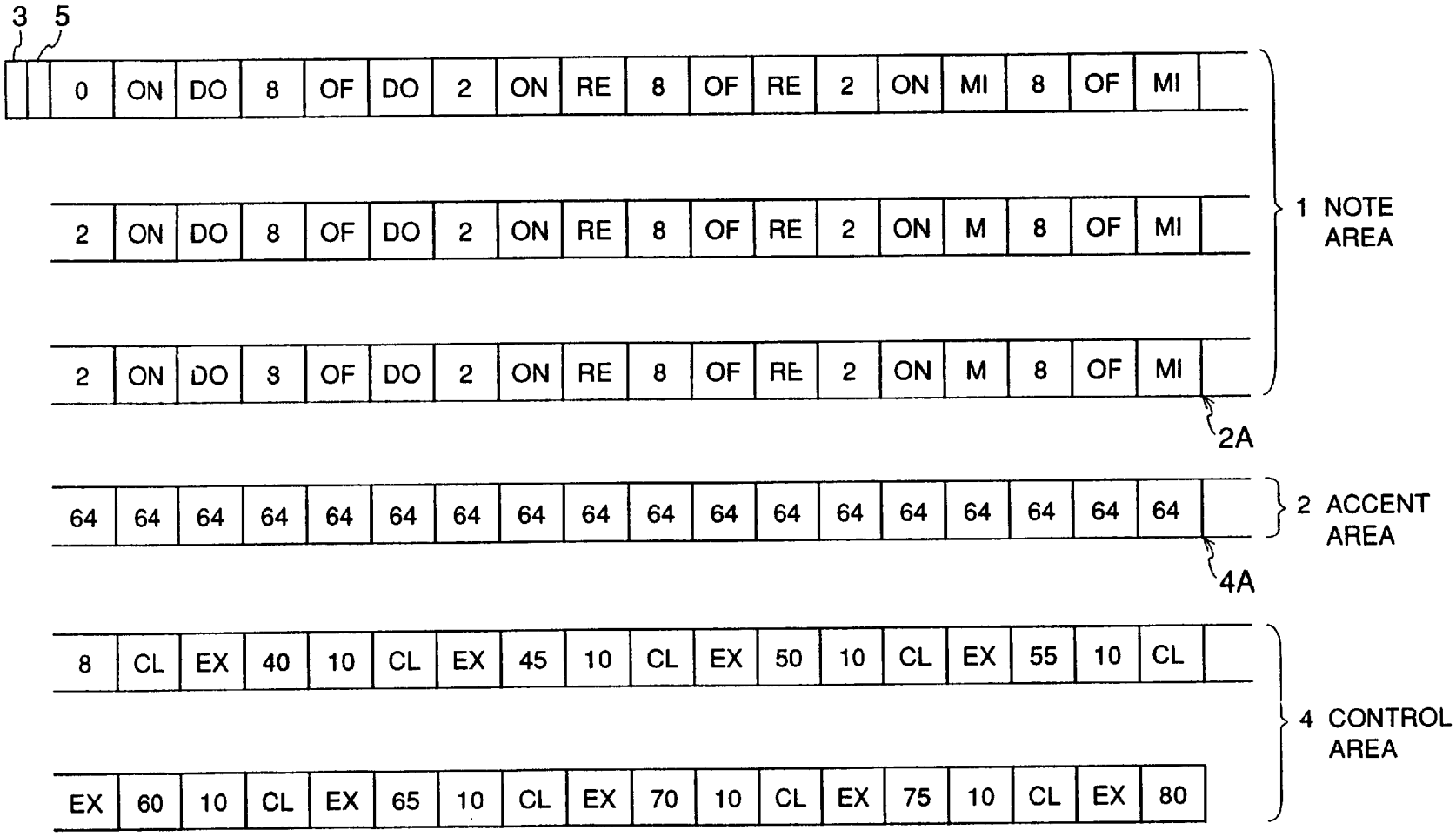
FIG. 7 is an illustration showing a data string obtained when the events are described in accordance of the second embodiment according to the present invention.

In the present invention, therefore, the MIDI event data having time data are recorded at areas different according to the three sort of the data, as shown in FIG. 7. In FIG. 7, the accent data (e.g., [64]) are taken out of the event data other than the control events, and only the remaining note data are recorded in time series (from the upper stage to the third stage). After that, only the taken-out accent data are recorded continuously (at the fourth stage). Further, following the accent data, the control data of the control events are recorded in time series. As a result, the three data can be recorded by separating the recording areas, respectively.

Figure 8:
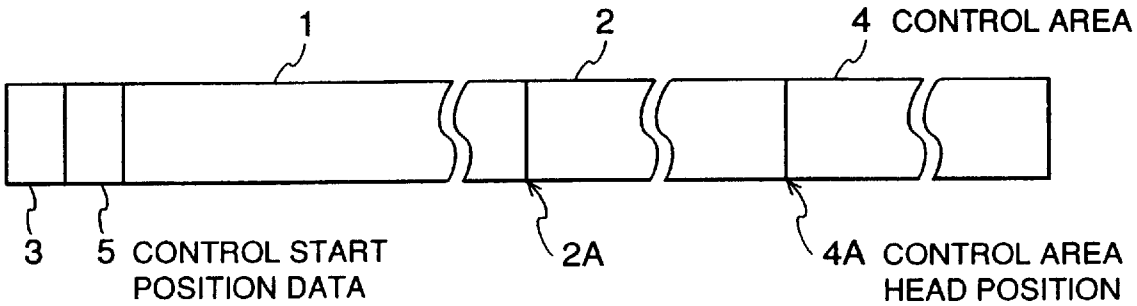
FIG. 8 is an illustration showing the data string shown in FIG. 7 in a more abstract form.

FIG. 8 shows the division of these areas. In this case, the front stage is the note area 1 for recording the note data, and the middle stage following the front stage is the accent area 2 for recording the accent data; and the rear stage following the middle stage is the control area 4 for recording the control data.

Here, the following point should be noted: since only the control evens are extracted from the first event string of the SMF and then arranged together in the other area of the file, it is necessary to calculate the relative time between the events again in both the strings of the extracted event string and the remaining event string. In the present invention, the time data of the control event is rewritten as a relative time to the preceding control event. In other words, the relative time between the control events are collected together and rewritten, by adding the invent times other than the control events arranged midway; that is, by adding the time 2 and the time 8.

In this example, as shown in FIG. 8, immediately after the note area 1 for recording the note data, the accent area 2 for recording the accent data is arranged, and the control area 4 for recording the control data is arranged following the accent area 2. Therefore, data related to the head positions 2A and 4A of the accent area 2 and the control area 4 are recorded at the head area of the file as the accent start position data 3 and the control start position data 5, so that the boundaries between the respective areas can be discriminated.

Further, in this embodiment, since sound volume data are included in the control data and the sound volume data are controlled thereby, the accent data recorded in the accent area 2 are only necessary when formatted. Therefore, this numerical value can be set to any value on the program, without having any meaning on the musical performance.

Therefore, when this numerical value is set to the same value (e.g., [64]) in FIG. 7, it is possible to increase the data compression efficiency.

When the data string as described above is compressed in accordance with the compression method based upon the pattern matching, since the note area 1 and the accent area 2 are the same data pattern in both data size and data length, it is possible to improve the data compression efficiency markedly, in the same way as with the case of the first embodiment.

In the case of the example shown in FIG. 7, the pattern from the first [ON] of the first string to the last [mi] of the same string is the same as the pattern from the first [ON] of the second string to the last [mi] of the same string and the pattern from the first [ON] of the third string to the last [mi] of the same string, respectively. Further, since the accent area 2 is all [64] and therefore the same pattern, this string can be compressed.

Therefore, the note area 1 and the accent area 2 in the file are the same pattern in both data size and data length. And hence, when the data file is compressed, it is possible to increase the compression efficiency markedly, as compared with when the SMF is simply compressed.

Figure 9:
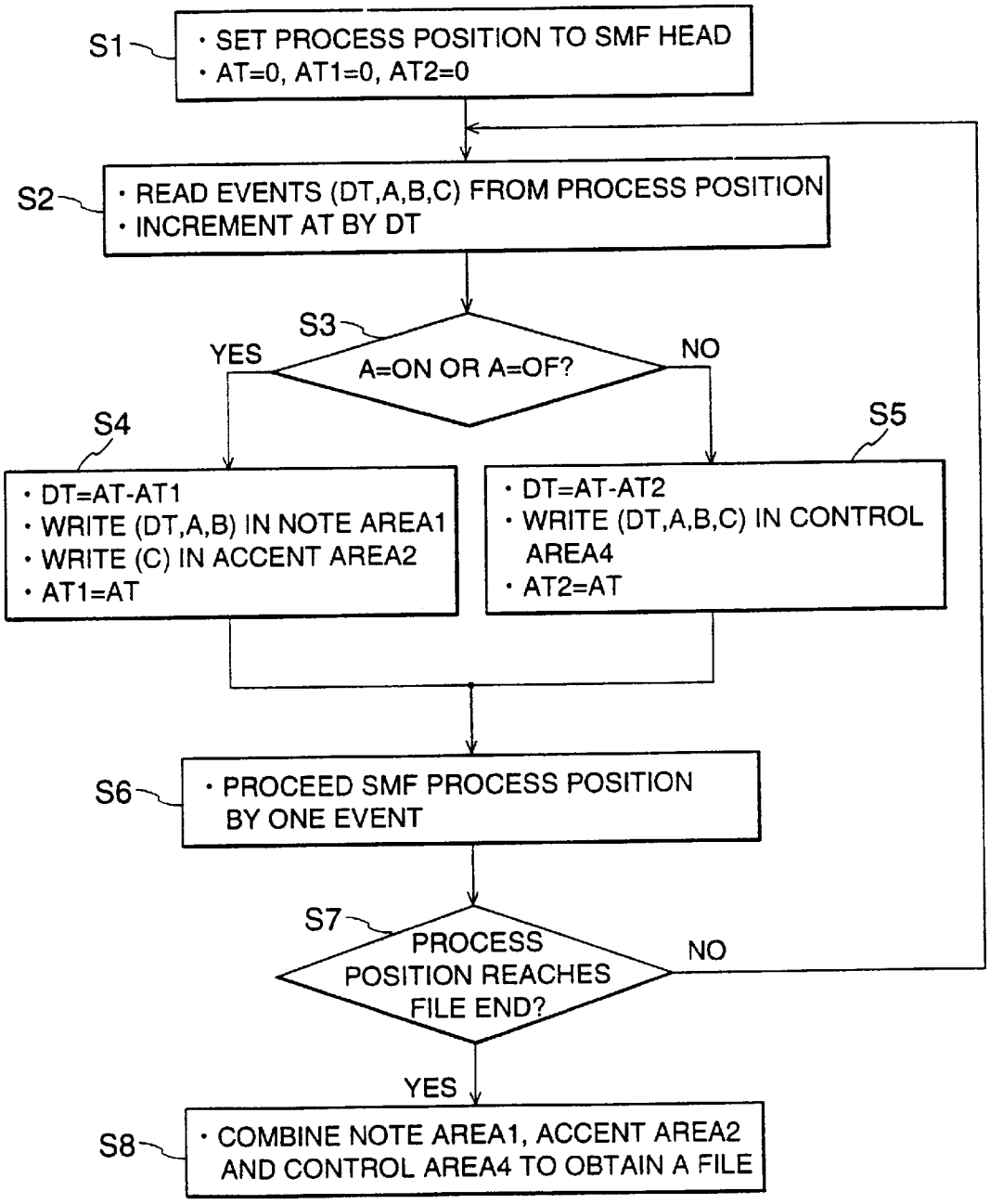
FIG. 9 is a flowchart for forming a data string shown in FIG. 7.

In the method of recording musical data according to the present invention, the method of converting data from the SMF file to the file format of the second embodiment will be described hereinbelow with reference to the flowchart shown in FIG. 9.

First, in step S1, the SMF to be converted is opened, and the processing position is set to the file head. Further, AT, AT1, and AT2 are all initialized to "0".

Here, AT is an absolute time from the music head of the events; AT1 is an absolute time from the music head of the events written in the past in step S4; and AT2 is an absolute time from the music head of the events written in the past in step S5. Further, in FIG. 5, when the music head is determined as an absolute time of "0", the absolute time of each event can be obtained by adding the time data recorded at the left end by DT accumulatively.

Successively, in step S2, events (DT, A, B, and C) each having time data are read through a SMF processing unit. Further, a relative time DT is added to the event time data DT to obtain an absolute time of the event now read.

Further, in step S3, processing is branched on the basis of the value of A. That is, when A=ON (the sound start event) or A=OF (the sound stop event), YES is decided; and when A=CL (control event), No is decided. Here, YES is always decided in case of converting data from the SMF file to the file format of the first embodiment that has no control event.

Further, in step S4, when A=ON or A=OF in step S3, the event contents are written in the note area 1 for recording note data and the accent area 2 for recording accent data as shown in FIG. 8. At this time, since the DT now written in the note area 1 is a relative time from the event written in the note area 1 in the nearest past, the DT is calculated again and then recorded. At this time, this value of AT is written as AT1.

Further, in step S5, when A is not ON or OF in step S3; that is, when A=CL (control event), the event content is written in the control area 4 for recording control data. At this time, since the DT now written in the control area 4 is a relative time from the event written in the control area 4 in the nearest past, the DT is calculated again and then recorded. In other words, the time difference between the preceding event and the present event is obtained. At this time, this value of AT is written as AT2.

Further, in step S6, the processing position of the SMF is advanced by one event (the data contents read in step S2).

In step S7, the processing position of the SMF is discriminated as to whether located at a file end. If YES; that is, when there exists no data to be processed, procedure proceeds to step S8. However, if NO; that is, when there exists data to be processed, procedure returns to step S2 to repeat the similar processing as described above.

Further, in step S8, the note area 1 for storing the note data, the accent area 2 for storing the accent data and the control area 4 for storing the control data are all combined with each other to obtain a target file as shown in FIG. 7. The obtained target file is recorded in a storage medium by a known recording method.

A reproducing apparatus for reproducing the musical performance data compressed in accordance with the musical data recording method according to the present invention as described above will be explained hereinbelow.

Figure 10:
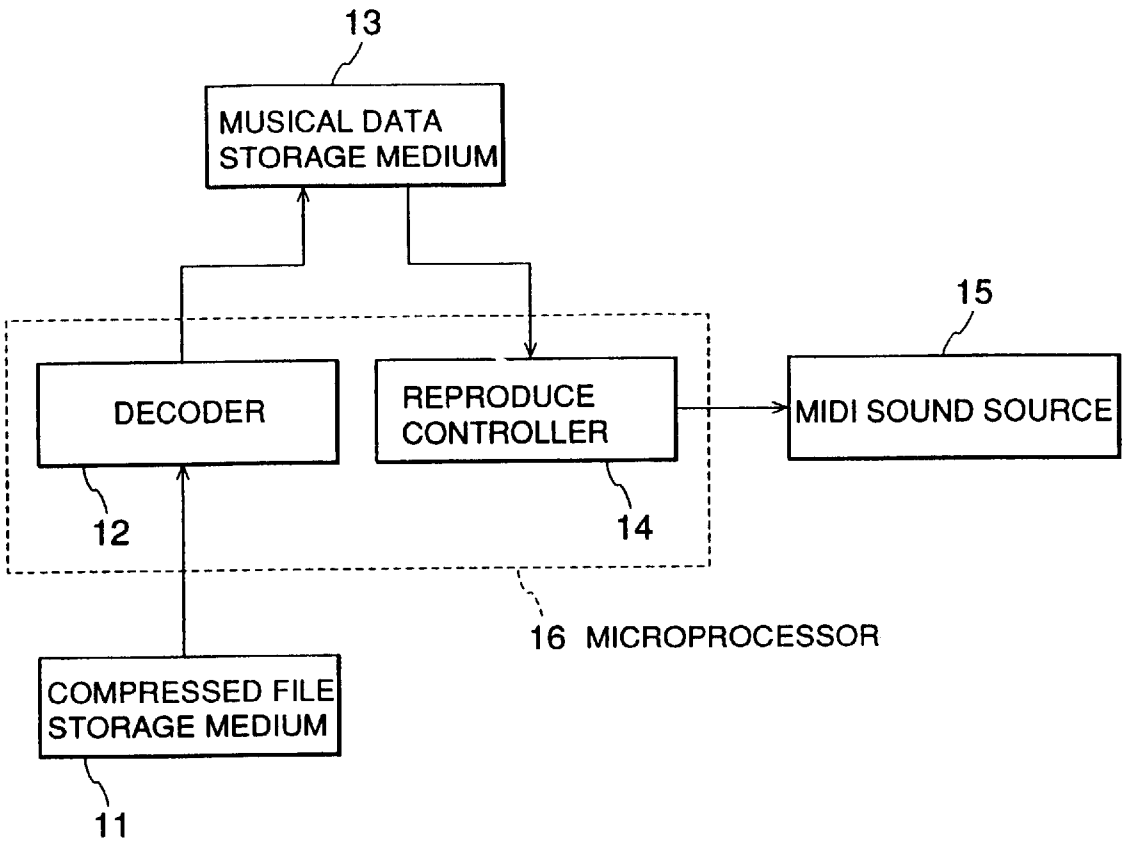
FIG. 10 is a block diagram showing a reproducing apparatus according to the present invention.

As shown in FIG. 10, the reproducing apparatus is mainly provided with: a compressed file storage medium 11 for recording a compressed file (in which a musical data file obtained in accordance with the recording method as described above is compressed by pattern matching method); a decoder 12 for decoding this file to obtain the original data; a musical data storage medium 13 for storing the decoded musical data temporarily; a reproduction controller 14 for sequentially processing the decoded musical data; and a MIDI sound source 15 for reproducing and generating the processed output data as actual music sounds.

The compressed file storage medium 11 is a large capacity disk (e.g., a hard disk) for recording a compressed file transmitted through a transmission line (e.g., a telephone line). Further, the musical data storage medium 13 is a high response speed read/write memory (e.g., RAM) so as to cope with the reproducing speed of the MIDI data. Further, the decoder 12 and the reproduction controller 14 are incorporated in a microprocessor 16 for executing arithmetic processing of the musical data in accordance with software.

The reproducing processing of the musical data will be described hereinbelow with reference to FIG. 11. The compressed file recorded in the storage medium 11 is decoded by the decoder 12, so that the decompressed musical data can be obtained. The obtained musical data are stored in the musical data storage medium 13 in accordance with the recording format as shown in FIG. 8, for instance.

Figure 11:
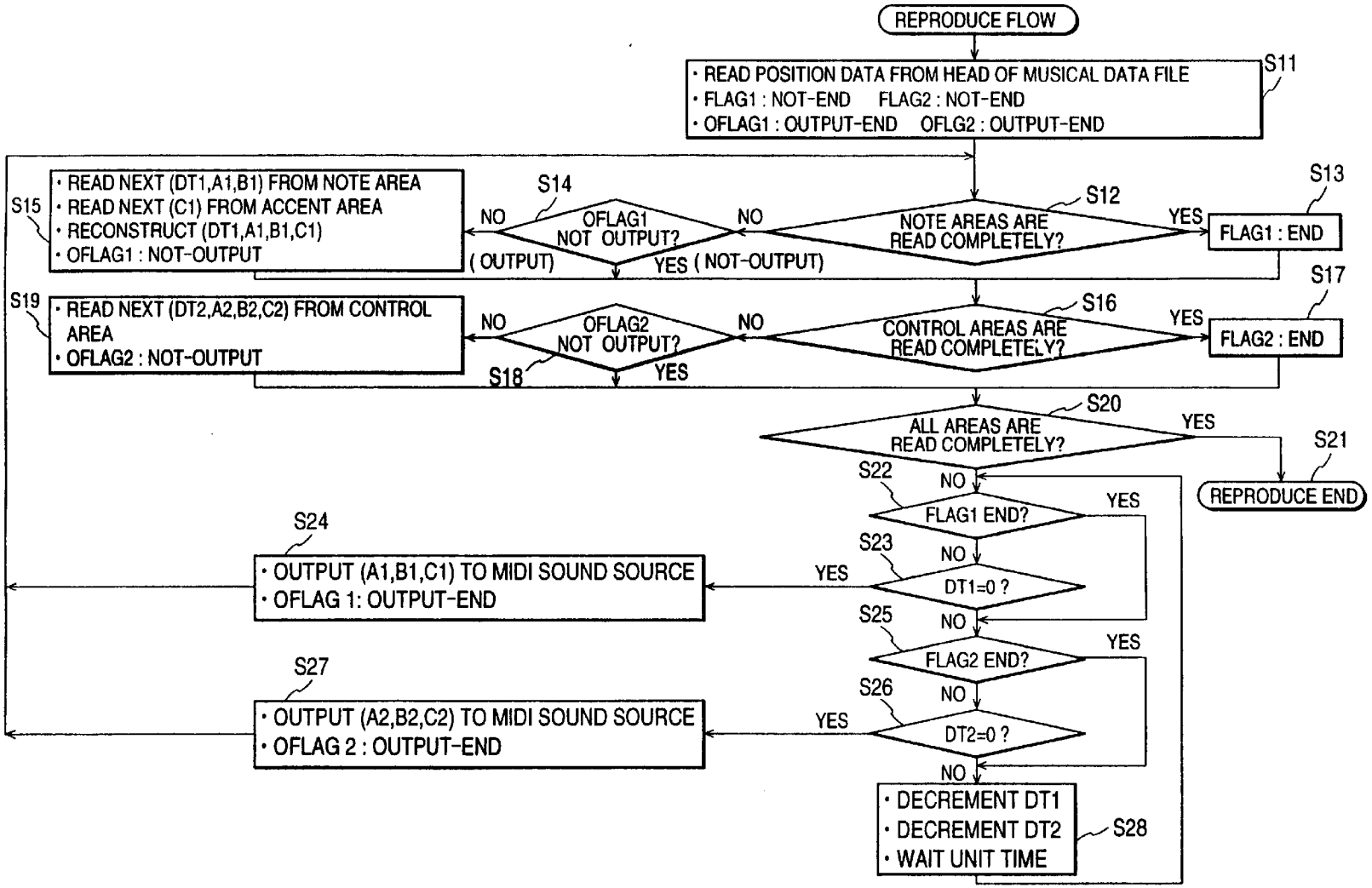
FIG. 11 is a flowchart showing a reproduction procedure executed by the reproducing apparatus shown in FIG. 11.

The reproduction controller 14 reproduces the MIDI data by processing the musical data file in accordance with the processing procedure as shown in FIG. 11, and generates musical sounds by the MIDI sound source 15 as follows:

First, in step S11, from the head position of the musical data file recorded in the musical data storage medium 13, the accent start position data 3 and the control start position data 5 as shown in FIG. 8 are read in order to enable data to be read from each head of the note area 1, the accent area 2, and the control area 4. Here, the head of the note area 11 is located adjacent to the position of the control start position data 5. Further, two flags flag1 and flag2 are prepared. The first flag flag1 is assumed to indicate the reproduction status from the note area and the accent area, and the second flag flag2 is assumed to indicate the reproduction status from the control area. Prior to reproduction, these two flags are initialized to "not-end" status. In addition, two other flags oflag1 and oflag2 are prepared. The first flag oflag1 indicates the output status of each MIDI event read from the note area 1 and the accent area 2, and the second flag oflag2 indicates the output status of each MIDI event read from the control area 4. These two flags oflag1 and oflag2 are initialized to "output-end" status.

Further, in step S12, it is discriminated whether all the contents are read from the note area for reproduction. If the contents to be read next from the note area 1 are absent (YES), procedure proceeds to step S13 to set the flag1 to "end". On the other hand, if the contents to be read next from the note area 1 are present (NO), procedure proceeds to step S14 to check the status of the flag oflag1, that is, to check the output status of each MIDI event read from the note area 1 and the accent area 2. Here, if NO; that is, if already outputted, procedure proceeds to step S15. Here, the data (DT1, A1, B1) as explained with reference to FIG. 1 are read, and further the accent data (C1) is read from the accent area 2. In addition, the read data (DT1, A1, B1) and the data (C1) are reconstructed as new data (DT1, A1, B1, C1) so as to be outputted to the MIDI sound source 15 as the MIDI events (A1, B1, C1). Further, the flag flag1 is set to "not-output" status. When read, although data are read in sequence beginning from the head in each area, the discrimination as to whether all the contents are read can be executed only for the note area. Because the note data (DT1, A1, B1) and the accent data (C1) correspond to each other one to one correspondence, and further the readings of all the contents are completed simultaneously in both the note area and the accent area.

Successively, in steps S16, S17, S18 and S19, the same processing as in steps S12, S13, S14 and S15 are executed for the control area 4. In more detail, if all the contents are not yet read from the control area 4 (NO), the status of the flag oflag2 is checked (in step S18). If NO (already outputted), in step S19, the control data (DT2, A2, B2, C2) as explained with reference to FIG. 5 are read from the control area 4, and the flag oflag2 is set to "not-output" status. Further, when all the contents are read in step S16 (YES), the flag flag2 is set to "end" (in step S17). Here, the numerals attached to each data element are used to discriminate the data (DT1, A1, B1, C1) reconstructed on the basis of the note data and the accent data.

Next, procedure proceeds to step S20 to check whether all the contents are read from the note area 1, the accent area 2 and the control area 4. This can be made by discriminating whether the two flags flag1 and flag2 indicate "end", respectively. If both the flags flag1 and flag2 indicate "end" (YES), procedure proceeds to step S21 to complete all the reproduction processing. If NO, on the other hand, procedure proceeds to step S22.

In step S22, procedure checks the status of the flag flag1. If the flag flag1 indicates "end" (YES), procedure skips the succeeding processing related to data output, and branches to step S25. This is because the reproduction of the MIDI events from the note area 1 and the accent area 2 have been already completed. If the flag flag1 indicates "not-end" (NO), since the MIDI events (A1, B1, C1) read but not yet outputted are present, the output processing after step S23 is executed. In more detail, in step S23, the value of DT1 indicative of time data of the event is checked. Here, DT1 indicates the time until the data (A1, B1, C1) are outputted. Therefore, if DT1=0 (YES), since this indicates that the current time is a time at which the data (A1, B1, C1) are to be outputted to the MIDI sound source 15, procedure branches to step S24. In step S24, the MIDI events (A1, B1, C1) are outputted to the MIDI sound source section 15, and the flag oflag1 is set to "output-end". In step S23, if DT1 is not 0 (NO), a time is necessary to output the data (A1, B1, C1). Therefore, in step S23, DT1 is checked again. Further, in step S28, DT1 is changed to a value smaller by one. In step S28, a waiting of unit time is executed.

Further, in steps S25, S26 and S27, the similar processing as in steps S22, S23 and S24 are executed for the MIDI events (A2, B2, C2) already read but not yet outputted. That is, in steps S25 and S26, the status of the flag flag2 is checked. If DT2=0 (YES), in step S27, the MIDI events are outputted to the MIDI sound source 15, and the flag oflag2 is set to "output-end".

If procedure proceeds to step S28, there exists at least one of the MIDI events (A1, B1, C1) or (A2, B2, C2) already read but not yet outputted. To output these events at a correct time, in step S28, both DT1 and DT2 are reduced by one, respectively, and procedure proceeds to step S22 after a unit time has been waited.

As described above, in each of the above embodiments, although the SMF has been explained as the conventional musical performance data file. Without being limited only thereto, however, as far as the musical performance data file includes note data and at least one of accent data and control read, and further these data are recorded in occurrence sequence, it is possible to reduce the data capacity by compressing the musical data effectively in accordance with the method according to the present invention.

An embodiment of an apparatus for compressing musical performance data according to the present invention will be described hereinbelow.

Figure 12:
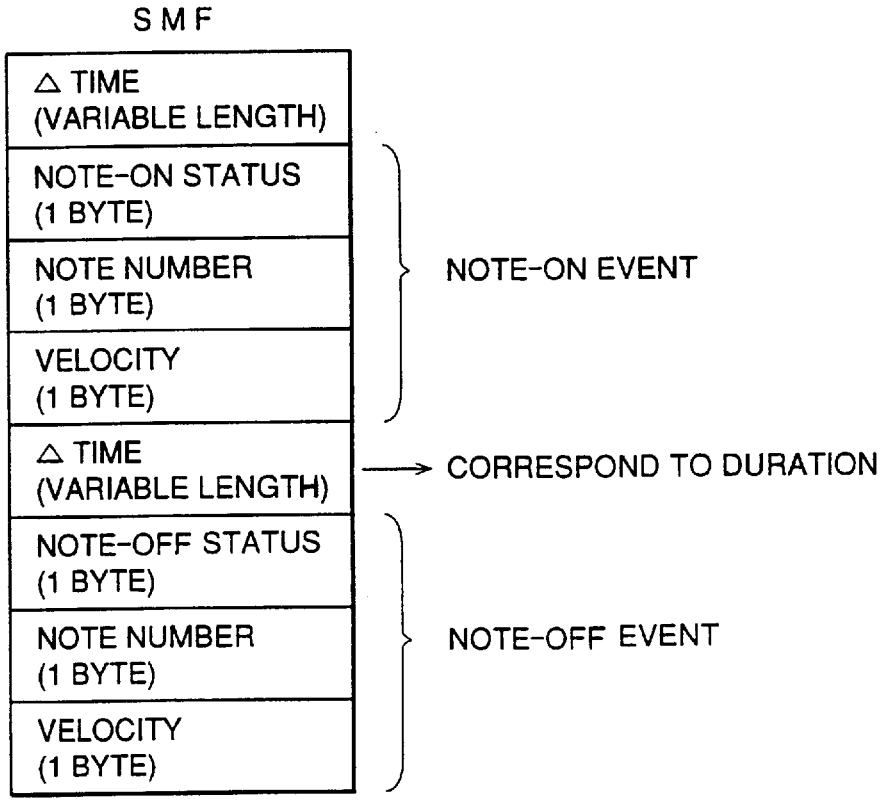
FIG. 12 is an illustration showing the relationship between Δtimes of the SMF for representing notes and the duration of the present embodiment.
Figure 13:
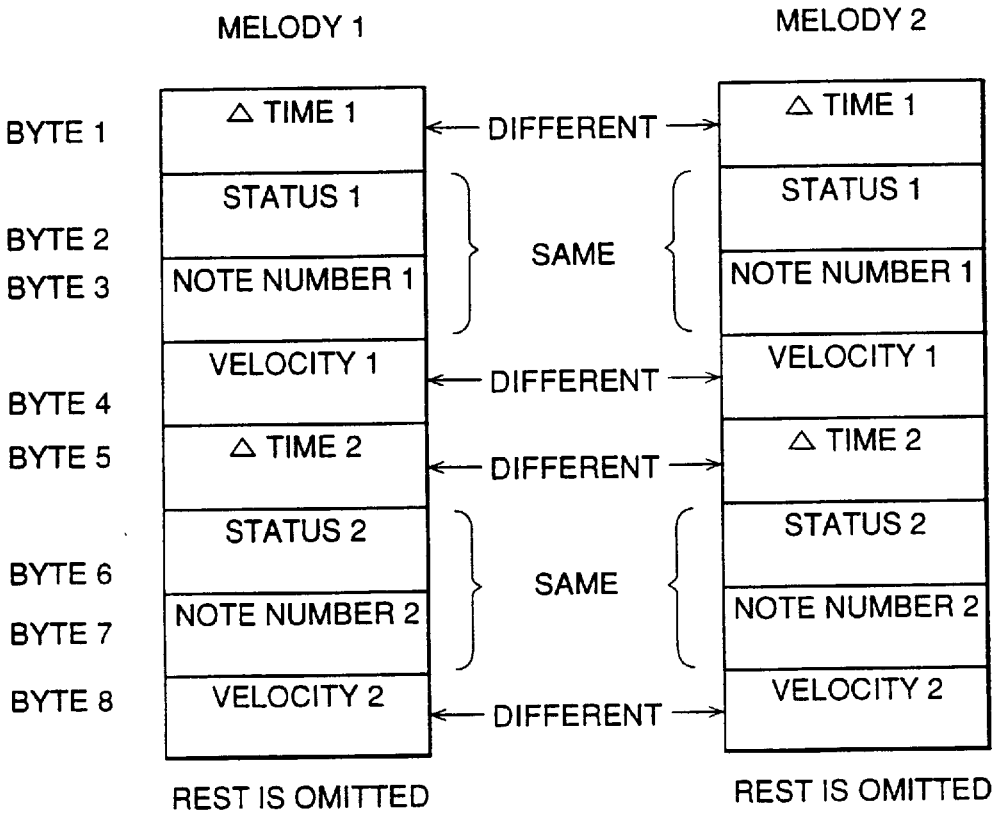
FIG. 13 is an illustration showing a format of the SMF.

First, data to be compressed by the compressing apparatus are SMF (standard midi file) data as shown in FIGS. 12 and 13, for instance. The format of the SMF is constructed by Δtimes, statuses, note numbers and velocities. Here, the Δtime represents a relative time between two adjacent events, and the event includes various musical data such as note-on status, note-off status, note number, velocity, etc. Here, the musical performance data include various musical data such as sound velocity, tune in music performance, tempo, sound source sort, reset control, etc. in addition to note number represented by note, sound duration, etc. Further, in the SMF, tracks are formed by arranging various musical data in time sequence.

Further, when two melodies are the same when represented by a sheet of music, there exist many cases where the two melodies are not perfectly the same when represented by the SMF data. FIG. 13 shows the SMF data of two similar melodies 1 and 2 by way of example, each of which is composed of the Δtimes, statuses, note numbers, and velocities. In this case, even if the two melodies are the same in music, the Δtimes and the velocities are different between the two melodies in order to avert the monotonous repetition and/or to add modulation.

In the present specification, [sound start event] is referred to as [note-on event], and [sound stop event] is referred to as [note-off event], hereinafter. Further, both the [note-on event] and [note-off event] are referred to as [note event] in combination, and [event] other than [note event] is referred to as [controller event], respectively.

Figure 14:
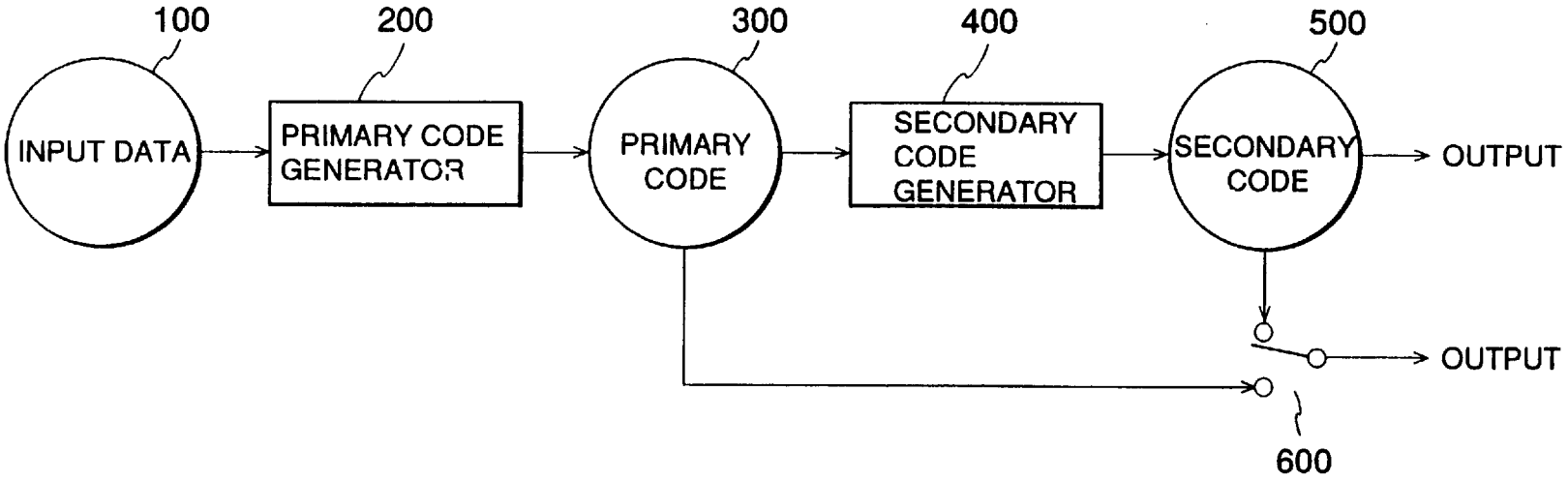
FIG. 14 is a block diagram showing an example of the musical performance data compression apparatus according the present invention.

In FIG. 14., input data 100 of the SMF format are analyzed by a primary code generator 200 to separate the musical data into at least note number, velocity, duration and other data. As a result, the primary codes 300 arranged at different areas independently can be formed. The primary codes 300 are compressed at each area by a secondary code generator 400 in accordance with LZ (Lempel-zif) method so as to form secondary codes 500.

The primary codes 300 without compression and the secondary codes 500 are supplied to a switch 600. The codes 300 and 500 are selectively output via switch 600.

Figure 15:
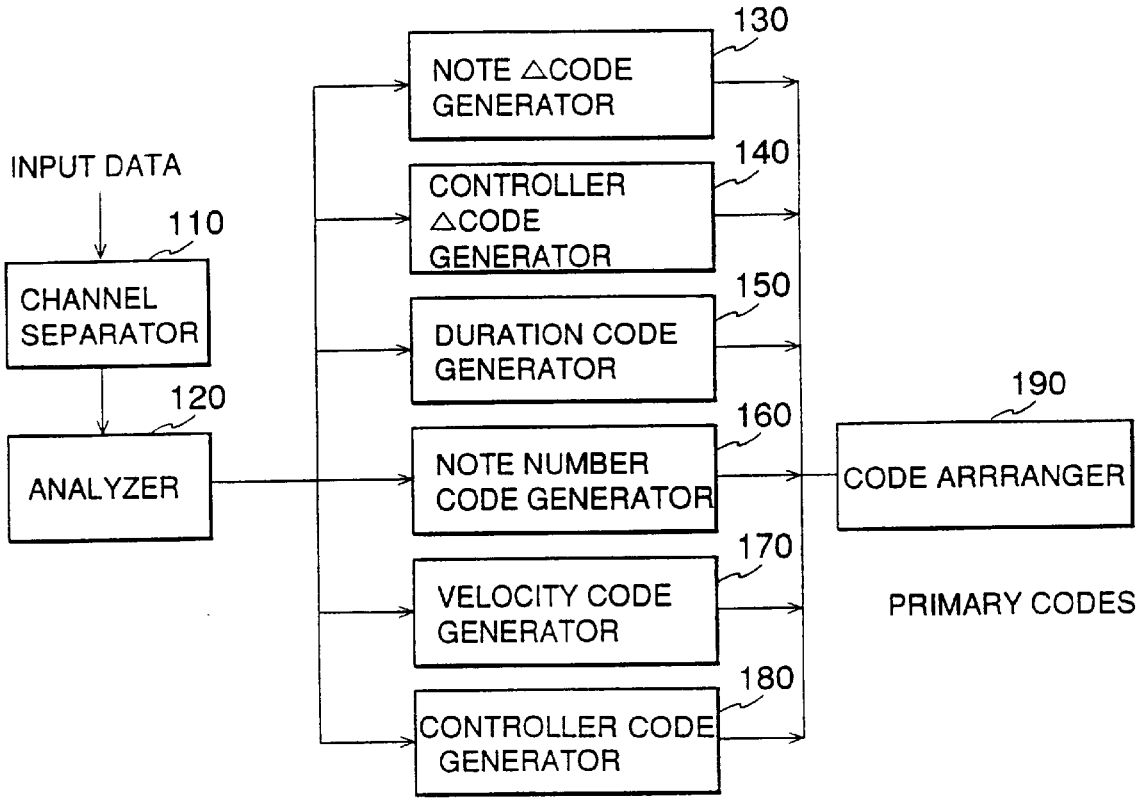
FIG. 15 is a detailed block diagram showing an example of the primary code generator shown in FIG. 14.

As shown in FIG. 15 in more detail, the primary code forming means 200 is provided with a channel separator 110, an analyzer 120, a note Δcode generator 130, a controller Δcode generator 140, a duration code generator 150, a note number code generator 160, a velocity code generator 170, a controller code generator 180, and a code arranger 190. Further, in this example shown in FIG. 15, the primary compressed codes of six sorts of note Δcode indicative of one note, controller Δcode, duration code, note number code, velocity code and controller code are rearranged by the code arranger 190, and then outputted to the secondary code generator 400 as the primary codes 300, for the succeeding secondary compression.

The channel separator 110 checks whether a plurality of channel events are included in one track of input data 100 of the SMF format or not. When a plurality of channel events are included, the track is divided so that only one channel can be included in one track. Further, the channel separator 110 forms a channel map indicative of the correspondence between the track and the channel number as shown in FIG. 16. Therefore, after that, the processing is executed in unit of track. Here, although almost all SMF events include channel data, it is possible to omit the channel data for each event by dividing the tracks and further forming the channel map. This results in low data quantity.

Figure 17:
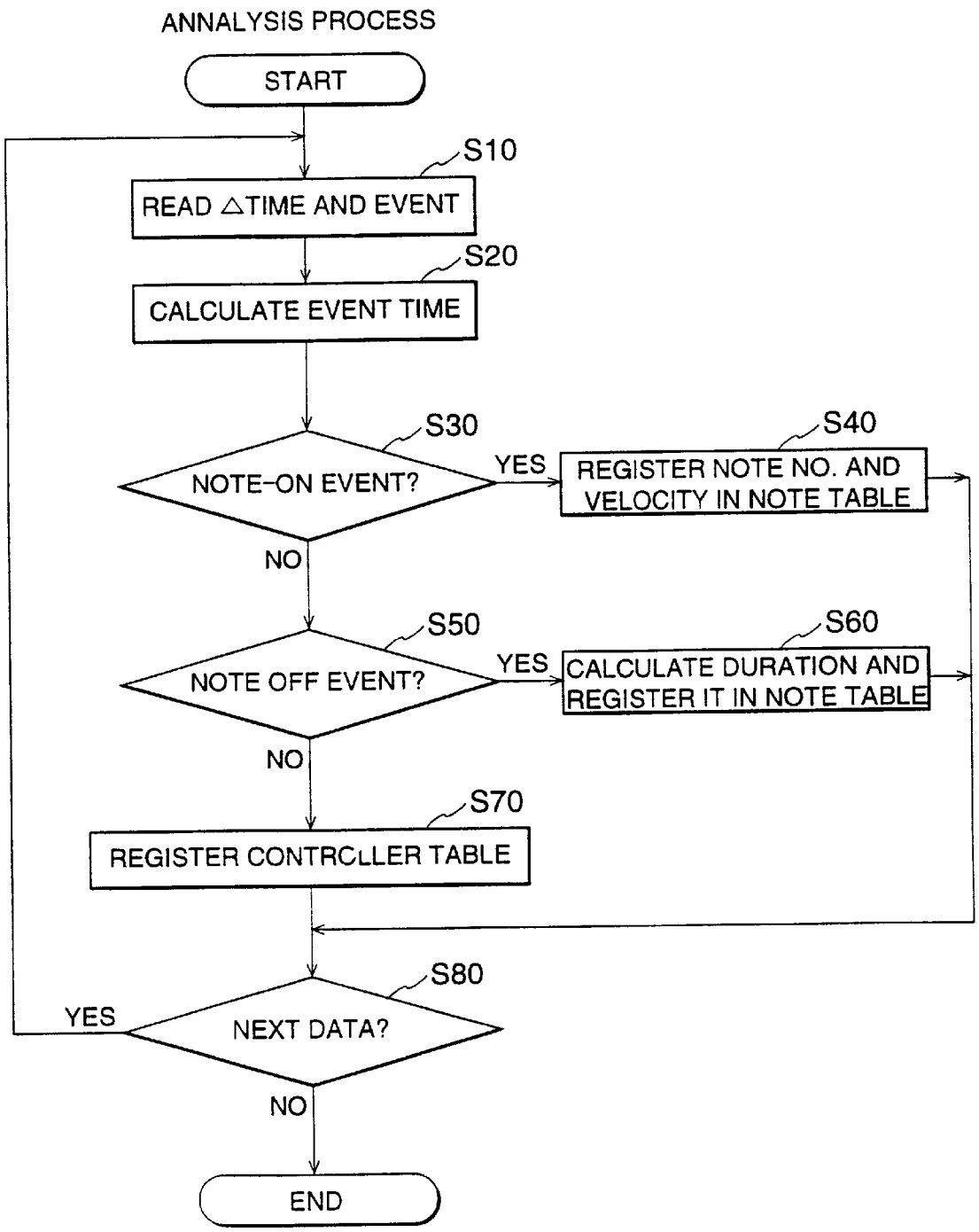
FIG. 17 is a flowchart for assistance in explaining the processing of the analyzer shown in FIG. 15.

The analyzer 120 executes the processing as shown in FIG. 17, to form a note table as shown in FIG. 18 and a controller table as shown in FIG. 19. In FIG. 17, first, the Δtimes and events are read in sequence from the SMF (in step S10), and the event times from the track head are calculated on the basis of the read Δtimes (in step S20). Further, the events are analyzed, and then classified into three sorts of [note-on event], [note-off event] and [controller event], respectively.

In the case of the [note-on event], the note number and the velocity are registered in the note table as shown in FIG. 18 (in steps S30 to S40). In the case of the [note-off event], the duration is calculated and then registered in the note table (in steps S50 to S60). Further, in the case of the [controller event], the controller event is registered in the controller table as shown in FIG. 19 (in step S 70). Further, there exists the succeeding data, the Δtime and the event are read (in steps S80 to S10). As described above, the note table and the controller table can be formed for each musical data.

Here, note event data for each track are arranged in time series in the note table, as shown in FIG. 18. Further, controller data (other than the note data) for each track are also arranged in time series in the controller table, as shown in FIG. 19. Further, in the case of the [note-on event], when the note number and the velocity are written, the event time is written in a predetermined column of the note table, and further the [See note-off] column of the note table is set to an initial value of [0].

Further, if the event is note-off, the note table is scanned from the head to select the note having an event time earlier than the note-off event time, the same note number and the [See note-off] set to [0] for correspondence to the note-on event. Further, a difference (Toff-Ton) between the corresponding note-one time Ton and note-off time Toff is recorded in the [duration] column of the note table as [note duration], and further the [See note-off] is set to [1].

Here, although the concept of [duration] does not exist in the SMF, when this concept is used, since the note-off event can be omitted, the data capacity can be reduced. In the SMF, one note can be represented by a pair of the note-on event and the note-off event, as shown in FIG. 12. Further, the Δtime before the note-off event corresponds to the duration. Further, the note number of the note-off even is necessary to secure the correspondence to the note-on event. However, when the concept of duration is used to secure the correspondence between the note-on event and the note-off event, the note-off event can be eliminated.

Further, the velocity of the note-off event is almost not used by the sound source which receives the MIDI data. Therefore, there arises no problem when the velocity is omitted. Therefore, when the note-off event (three bytes) is omitted, although there exists the case where the data quantity of the Δtime increases, since the effect of omitting the note-off event is large, it is possible to reduce the three bytes at the maximum for each note. As a result, since a single music includes often about ten thousand notes, in this case, it is possible to reduce the 30 Kbytes at the maximum, so that the compression effect can be increased.

When the event is an event other than the note-on event and note-off event, the event time and the event contents are registered in the controller table. As described above, NA-units of events are registered in the note table, and the NB-units of events are registered in the controller table.

Figure 20:
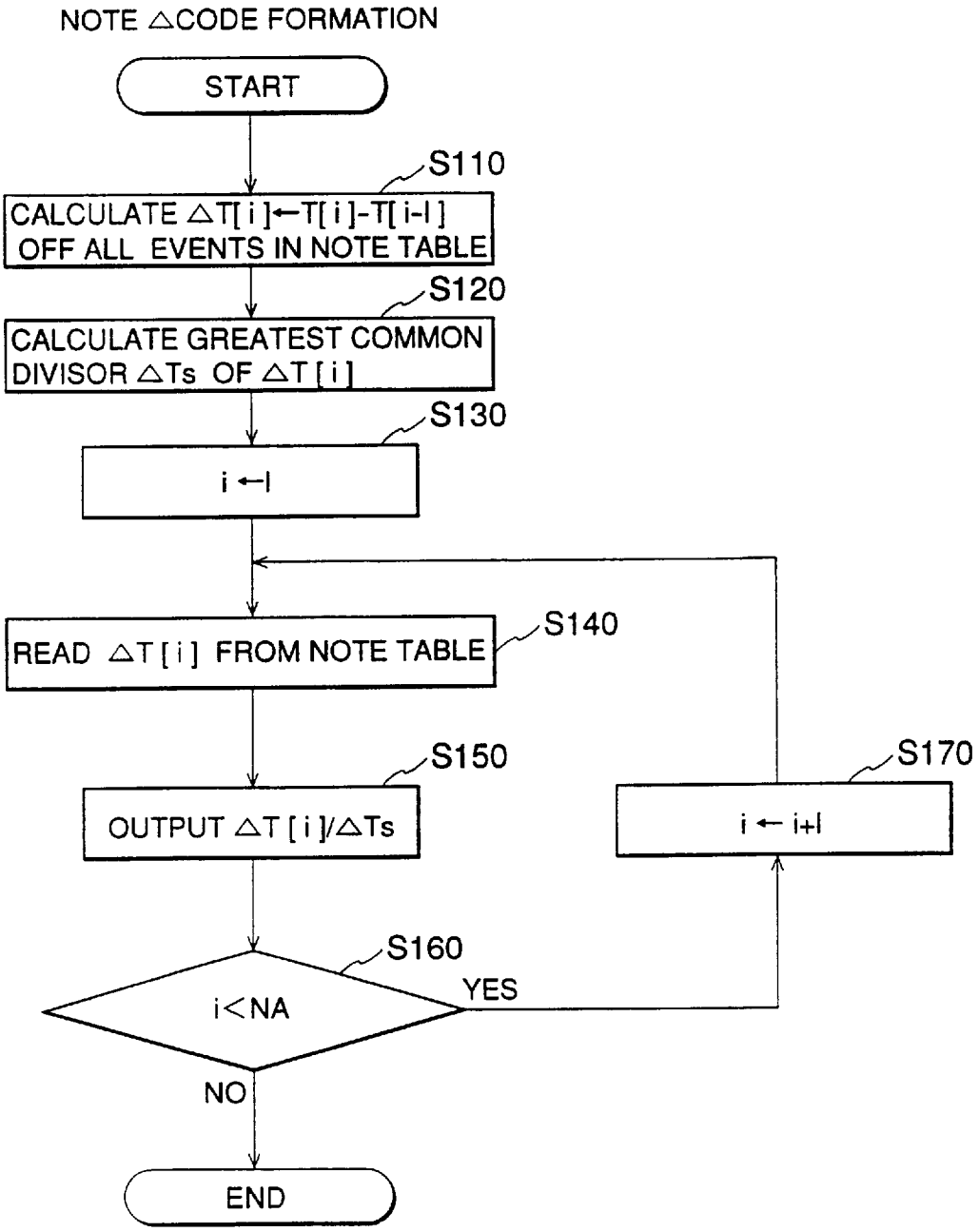
FIG. 20 is a flowchart for assistance in explaining the processing of the note Δcode generator shown in FIG. 15.

Here, the note Δcode generator 130 and the controller Δcode generator 140 both shown in FIG. 15 will be explained hereinbelow. Since the processing contents of both the Δcode generators are the same, only the note Δcode generator 130 will be explained by way of example. As shown in FIG. 20, the note Δcode generator 130 calculates a difference between the current time T[i] and the preceding time T[i−1] for each event registered in the note table (in step S110) as follows:

$$\Delta T[i]=T[i]-T[i-1]$$

where i=1 to NA, T[0]=0

The calculated values are written in the predetermined columns of the note table. In other words, each relative time between note events can be obtained.

Here, in the SMF, since the Δtime is represented by a variable length code in basic unit determined by a fraction of one beat, the number of bytes decreases with decreasing value of the Δtime. For instance, when the Δtime value is less than 127, one byte is enough. However, when the Δtime value is between 128 and 16383, two bytes are necessary. Although the power of musical representation can be increased when the basic unit of the Δtime is fine, the number of necessary bytes increases. On the other hand, when the Δtimes actually used in music are examined, as short a time as one tick of the basic unit is not usually used. Therefore, there are many cases where the Δtime values are recorded by use of a storage medium having a capacity more than necessity.

Therefore, in order to obtain the time precision actually used, the greatest common divisor ΔTs of all the relative times ΔT[i] registered in the note table is calculated and outputted as the note Δcode (in step S120). If it is difficult to obtain the greatest common divisor, an appropriate divisor may be determined as the greatest common divisor ΔTs. Next, the loop control variable [i] is set to one (in step S130), and then the relative times ΔT[i] registered in the note table is read therefrom (in step S140). After that, ΔT[i] is divided by ΔTs to output the note Δcode ΔTa[i] (in step S150). Next, the loop control variable [i] is compared with the number NA of events of the note table (in step S160). If [i]<NA, the value of [i] is increased by one (in step S170), and then the process goes back to the step S140. If not [i]<NA (in step S160), the process ends. Therefore, the note Δcode can be constructed by the greatest common divisor ΔTs and the NA-units of ΔTa[i] (i=1 to NA), as shown in FIG. 21.

Here, when the code compressed by the musical data compressing apparatus according to the present invention are decompressed, the original ΔT[i] can be restored by reading the ΔTa[i] and by multiplying the read ΔTa[i] by ΔTs. Therefore, it is possible to reduce the data quality without losing the power of the musical representation in the SMF. For instance, in the case where the basic unit of the Δtime is 1/480 beat (usually used) and Ts=10 in the SMF, two bytes are required to represent one beat duration of ΔT=480 or a half beat duration of ΔT=240. On the other hand, in the present invention, since ΔTs is divided for representation, the representation of ΔT=48 or ΔT=24 is enough, so that only one byte is used for each representation of ΔT. Further, since the Δtime corresponding to one beat or a half beat is often used, when one byte can be reduced for each Δtime, it is possible to reduce the considerable quantity of data in the entire music.

The controller Δcode generator 140 shown in FIG. 15 executes the quite the similar processing to that of the note Δcode generator 130, except that the processed table is not the note table but the controller table. Further, the format of the formed controller codes is basically the same as that of the note Δcode shown in FIG. 21, except that the number of codes is changed from NA to NB.

Figure 22:
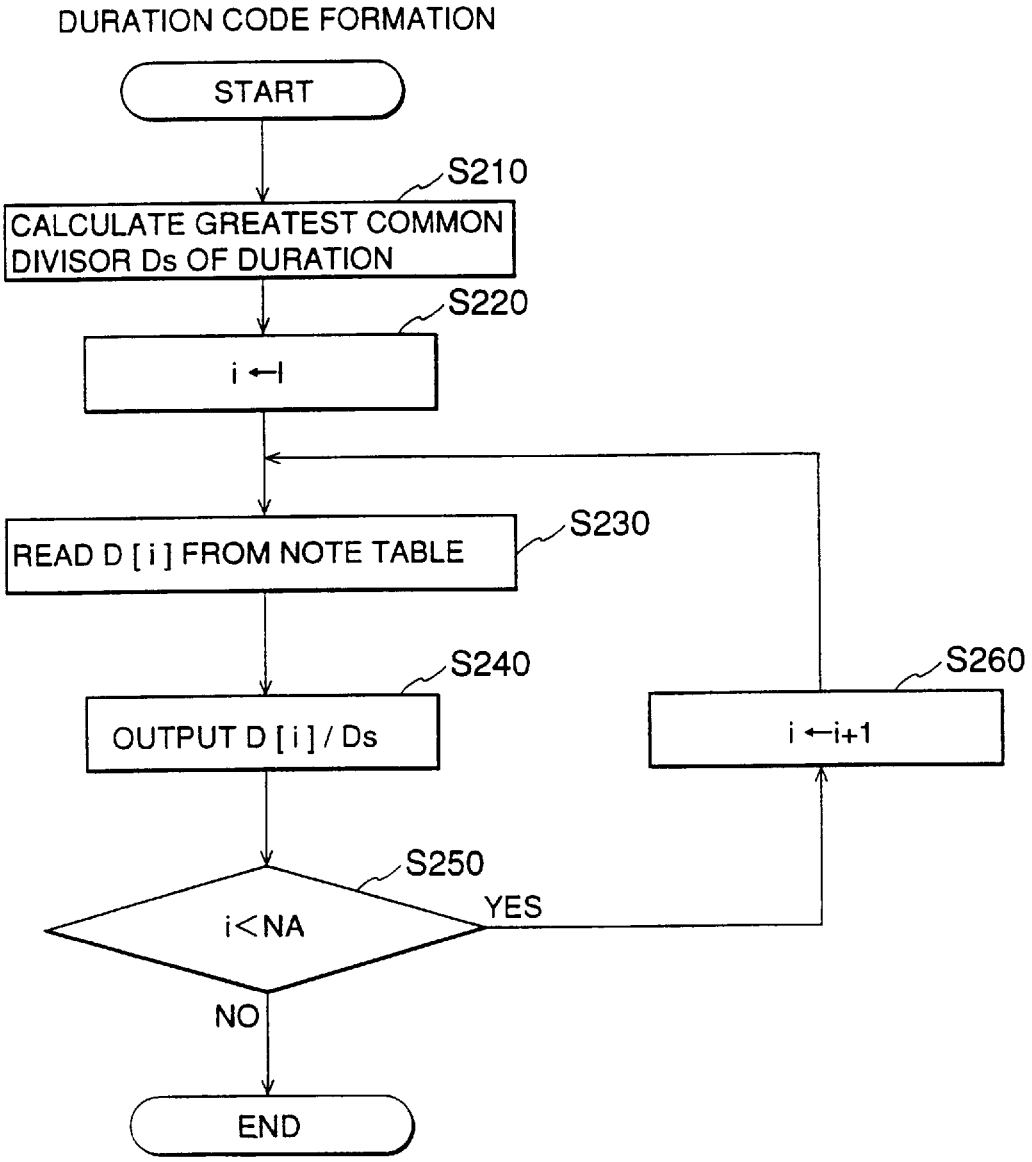
FIG. 22 is a flowchart for assistance in explaining showing the processing of the duration code generator shown in FIG. 15.
Figure 23:
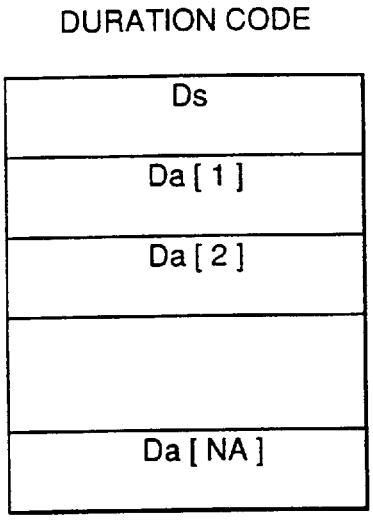
FIG. 23 is an illustration showing the duration codes formed by the duration code generator shown in FIG. 15.

The duration code generator 150 shown in FIG. 15 is roughly the same as the note Δcode generator 130, so that the generator 150 executes the processing in accordance with the procedure shown in FIG. 22. First, the greatest common divisor Ds of the respective durations registered in the note table is calculated and outputted as the duration code (in step S210). If it is difficult to obtain the greatest common divisor, an appropriate divisor may be determined as the greatest common divisor Ds. Next, the loop control variable [i] is set to one (in step S220), and then the duration D[i] registered in the note table is read therefrom (in step S230). After that, D[i] is divided by Ds to output the duration code Da[i] (in step S240). Next, the loop control variable [i] is compared with the number NA of events of the note table (in step S250). If [i]<NA, the value of [i] is increased by one (in step S260), and then the process goes back to the step S230. If not [i]<NA (in step S250), the process ends. The duration code is constructed by the greatest common divisor Ds and the NA-units of Da[i] (i=1 to NA), as shown in FIG. 23. Here, as already explained, since the duration corresponds to the Δtime between the note-on event and the note-off event in the SMF, it is possible to reduce the data quantity, as compared with that of the SMF for the same reason as explained in the note Δcode generator 130.

In the note number code generator 160 shown in FIG. 15, the following processing is executed for the note numbers registered in the note table, to form the note number code. Here, a note number num[i] is expressed by use of a function f() and remainders α[i], each remainder α[i] being the difference between a note number expressed by the function f() and an actual note number, in accordance with the following formula (1), where the variables of the function f() are the preceding S-units of note numbers as follows:

num [i−1], num [i−2], . . . , and mum [i−S]

in which num[i−1] denotes a note number one before the num[i]; and num[i−2] is a note number two before the num[i].

Figure 24:
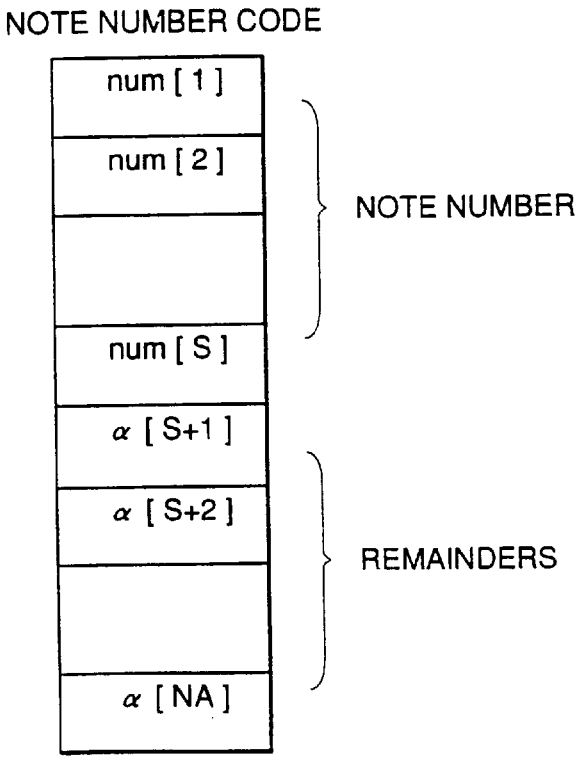
FIG. 24 is an illustration showing the note number codes formed by the note number code generator shown in FIG. 15.

As shown in FIG. 24, the note number code is constructed by arranging the note numbers for i≦S event and the remainders α[i] for i>S events in time series. Therefore, when the same function f() is used in both when compressed and decompressed, num[i] can be restored on the basis of the remainders α[i] as $$\text{num}[i]=f(\text{num}[i-1], \text{num}[i-2], \ldots, \text{num}[i-S])+\alpha[i] \quad (1)$$

where if the number of events is NA, $$i=(S+1), (S+2), \ldots, NA$$

Here, although various functions f() can be considered, when a function in which the same remainder value α[i] can appear repeatedly is selected, it is possible to increase the compression effect of the secondary code generator 400 as shown in FIG. 14. Here, the effect obtained when the function as shown by formula (2) will be explained by way of example. In this case, S=1 and a difference from the preceding note number is α[i]. However, if i=1, the note number itself is outputted as the note number code.

$$\text{num}[i]=\text{num}[i-1]+\alpha[i] \quad (2)$$

where if the number of events is NA, i=2, 3, . . . , NA

Here, in the case of the ordinary music, there often exist many melody lines shifted by the note number which is the same as the parallel shift rate of chord and root. For instance, when there exists a melody line of [do, do, mi, sol, mi] in {C} measure, there often exists a melody line higher than the first melody by two degrees, for instance such as [re, re, #fa, la, re] in [D] measure whose root is higher by two degrees.

Therefore, when the respective melody lines are represented by the note numbers themselves of the SMF as [60, 60, 64, 67, 60] and [62, 62, 66, 69, 62], there is no common data pattern between the two lines. However, when represented by the above-mentioned α[i], both the memory lines are [0, 4, 3, −7] in the second and after sounds, so that the same pattern can be obtained. As described above, it is possible to convert two data patterns different from each other in the SMF into the same pattern in accordance with the method according to the present invention.

In the LZ method, since the compression ratio can be increased with increasing the number of the same data patterns, it is apparent that the compression ratio can be increased by use of the note number representation method as described above. Further, in the formula (1), if S=0, num [i]=α[i]

so that the note numbers themselves can be coded. Further, it is also preferable to prepare a plurality of sorts of functions f() and to select the optimum function for coding. In this case, the data indicative of which function is used is preferably coded.

The velocity code generator 170 shown in FIG. 15 is basically the same as the note number generator 160.

Here, a velocity vel[i] of the note registered in the note table is expressed by use of a function g() and remainders β[i] in accordance with the following formula (3), where the variables of the function g() are the preceding T-units of note velocities as vel [i−1], vel [i−2], . . . , and vel [i−T]

in which vel[i−1] denotes a velocity one before vel[i]; and vel[i−2] is a note number two before vel[i].

Figure 25:
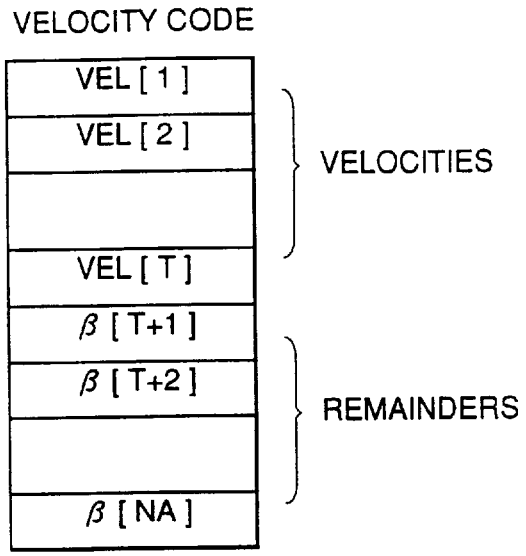
FIG. 25 is an illustration showing the velocity codes formed by the velocity code generator shown in FIG. 15.

As shown in FIG. 25, the velocity code is constructed by arranging the velocities for i≦T event and the remainders β[i] for i>T events in time series. Therefore, when the same function g() is used in both when compressed and decompressed, vel[i] can be restored on the basis of the remainders β[i] as $$\text{vel}[i]=g(\text{vel}[i-1], \text{vel}[i-2], \ldots, \text{vel}[i-T])+\beta[i] \quad (3)$$

where if the number of events is NA, $$i=(T+1), (T+2), \ldots, \text{and NA}$$

Further, when an appropriate function g() is selected, since β[i] of the same data pattern can appear repeatedly, it is possible to increase the compression ratio when the LZ method is used.

Figure 26:
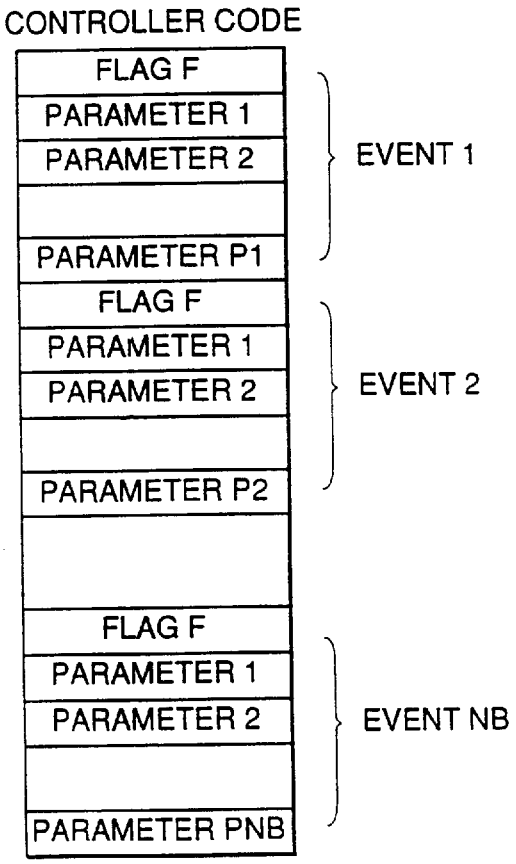
FIG. 26 is an illustration showing the controller codes formed by the controller code generator shown in FIG. 15.

The controller code generator 18 shown in FIG. 15 will be described hereinbelow. As shown in FIG. 26, the controller codes can be obtained by arranging in time series the event data registered in the controller table as shown in FIG. 19. Each controller code is constructed by a flag F indicative of the sort of the event and parameters (data bytes). The number of parameters is different according to the sorts of the events. The sorts of the events are roughly classified into two types of [ordinary event] and [continuous event]. Codes are assigned to the flags [F] and the parameters to discriminate therebetween. For example, the most significant bit of each flag [F] is set to [1] and the most significant bit of each parameter is set to [0]. Therefore, it is possible to achieve the representation of the running status the same as that of the SMF (when the sort of the event is the same as that of the preceding event, the flag F can be omitted).

Here, in the SMF, one-byte MIDI statuses are used to represent the sorts of the events in the SMF. The value generally used is any one of 8n(hex), 9n(hex), An(hex), Bn(hex), Cn(hex), Dn(hex), En(hex), Of(hex) and FF(hex), where n=0 to F(hex) and n is a channel number. The [ordinary events] are the MIDI statuses excluding the note-on 8n(hex) and the note-off 9n(hex). In the present invention, however, since it is unnecessary to represent the channel number as already explained, the sorts of flags of [ordinary events] are seven sorts. Therefore, the possibility of the same flags is higher as compared with the MIDI statuses, with the result that the compression ratio can be increased when the LZ method is adopted. The codes of the [ordinary events] are formed by arranging data bytes excluding one byte of the MIDI statuses of the SMF.

Further, in the SMF, there are many portions where the events of a specific sort appear continuously over a constant value and further the parameter values (data byte) of the respective events change under roughly a constant rule, for instance at a portion where [pitch wheel change] event is used. This event is used to increase the power of musical representation by changing the note number finely. In this case, a plurality of events whose parameters are different from each other are often used from the standpoint of the nature thereof. These events are referred to as [continuous event], and the portion is referred to as [continuous event block].

Figures 27, 28:
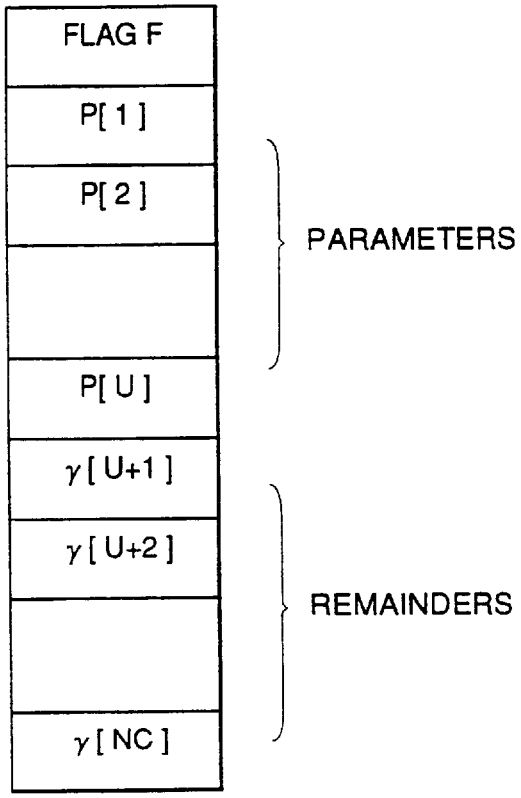
FIG. 27 is an illustration showing a continuous event block of the SMF.
FIG. 28 is an illustration showing the continuous event codes of the present invention.

In the following description, although the [pitch wheel change] is taken as an example of [continuous event], the [continuous event] is not limited only thereto. FIG. 27 shows an example of [continuous event block] of the SMF. In this case, since the parameters of each event are different from each other, the length of the same pattern of the SMF is two bytes of (one byte of Δtime and one byte of status) in total. In the case of the pattern length of this degree, the effect of compression in accordance with the LZ method is hardly obtained.

Here, the controller code is formed by executing the following processing in the area where [pitch wheel change] appears continuously beyond a constant value in the controller table and further the parameter value changes under roughly a constant rule. When the number of [pitch wheel change] is less than a constant value, this is coded as an [ordinary event].

Here, an event parameter p[i] in the continuous event block is represented by use of a function h() and remainders γ[i] in accordance with the following formula (4), where the variables of the function h() are the preceding U-units of event parameter values appearing before as $$p[i-1], p[i-2], \ldots, \text{and } p[i-U]$$

in which p[i−1] denotes an event parameter value one before the p[i]; and p[i−2] is an event parameter value two before the p[i].

As shown in FIG. 28, the continuous event code is constructed by arranging a flag indicative of the presence of a continuous pitch wheel change, parameter values for the first to the U-th events, and remainders γ(i) for the (U+1)-th event and after. Codes are assigned to the Flags[F] and the parameters to discriminate therebetween. Therefore, when the same function h() is used in both when compressed and decompressed, p[i] can be restored on the basis of the remainders γ[i] as $$p[i]=h(p[i-1], p[i-2], \ldots, p[i-U])+\gamma[i] \quad (4)$$

where if the number of events of the continuous event block is NC, $$i=(U+1), (U+2), \ldots, \text{and NC}$$

Here, although various functions h() can be considered, when a function in which the same remainder value γ[i] can appear repeatedly is selected, it is possible to increase the compression effect of the secondary code generator 400 as shown in FIG. 14. Here, the effect obtained when the function as shown by formula (5) will be explained by way of example. In this case, U=1 and a difference from the preceding note number is γ[i].

$$p[i]=p[i-1]+\gamma[i] \quad (5)$$

where if the number of events of the continuous event block is NC, $$i=2, 3, \ldots, \text{and NC}$$

According to the above-mentioned method, the area as shown in FIG. 27 can be converted into the controller code as shown in FIG. 29. In this case, since all the second and after event data are the same as [1], the compression ratio by the LZ method can be increased. Further, since Δtime is not included in the controller code, even when the Δtime differs for each event, the compression ratio by the LZ method is not reduced markedly. Further, instead of the above formula (4), it is also possible to use the following function e() as expressed by the formula (6) in which the time data of the events are used as a variable, t[i] denotes the event time for obtaining a parameter, and t[i−1] denotes a preceding event time, $$p[i]=e(p[i-1], p[i-2], \ldots, p[i-U], t[i], t[i-1], \ldots, t[i-U])+\gamma[i] \quad (6)$$

where if the number of events of the continuous event block is NC, $$i=(U+1), (U+2), \ldots, \text{and NC}$$

Figure 30:
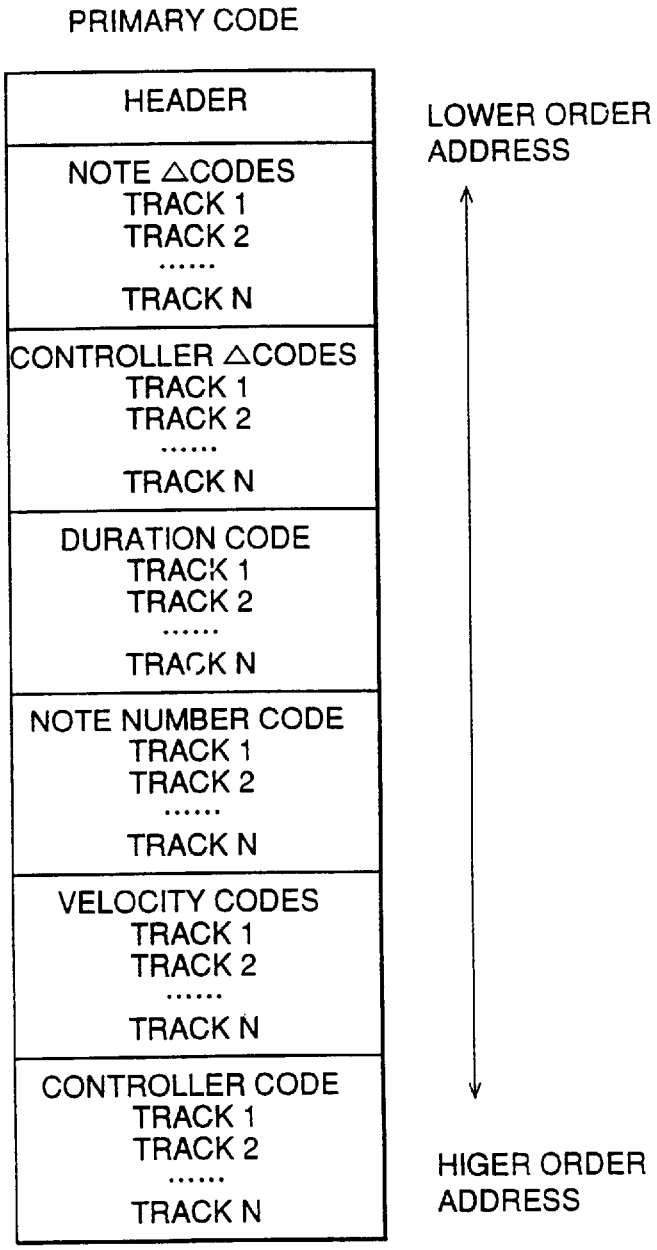
FIG. 30 is an illustration showing the primary codes rearranged by the code arranger shown in FIG. 15.

The code arranger 190 shown in FIG. 15 arranges the above-mentioned respective codes in the areas as shown in FIG. 30, to form the primary codes 300 as shown in FIG. 14. The header of each code includes management data such as start address and code length and the above-mentioned channel map. As already explained, although the respective codes have such a nature that the number of appearance times of the same data is large and that the data length of the same data pattern is long, as compared with the SMF. In this case, however, the arrangement is devised in such a way that the same data pattern can appear at the shorter distance. First, since the possibility of appearance of the same data string is high in the codes of the same sort, the codes of the same sort are arranged in the order of tracks. Further, since the note Δcodes, the controller Δcodes and the duration codes are all time-related data, and thereby since the appearance possibility of the same data string is higher than that of the note number codes and the velocity codes of different nature, these time-related data are arranged closer to each other.

Here, returning to FIG. 13, how much the length of the same data pattern can be reduced will be examined. Here, the assumption is made that each melody is constructed by 50-units of note-on events and 50-units of note-off events; all the Δtime are of one byte; and all the events are of three bytes. Then, all the note numbers are the same for each melody, as already explained.

Therefore, the data quantity of each melody in the SMF are $$(1+3)\times 50\times 2=400 \text{ bytes}$$

When all the Δtimes and velocities of each melody are the same, the same data pattern length is 400 bytes. However, if all the Δtimes and the note-on velocities are different from each other between the two melodies, the maximum length of the same data pattern in the SMF is three bytes in the arrangement of the note-off status, the note number and the velocity. In the case of the compression of this degree, there exists no effect by the LZ method.

On the other hand, in the present invention, since the Δtime, the note number and the velocity are coded separately, the same data pattern of 50 bytes appears at least in the note number codes. Further, as already explained, even if the velocities of the SMF are all different from each other, the same data pattern often appears in the velocity codes. Therefore, the compression ratio by the LZ method can be clearly improved. As understood above, in the primary codes 300 as shown in FIG. 14, the data quantity can be reduced without at all reducing the musical data quantity included in the SMF, and further there exists a nature that the length of the same data pattern is long; the number of appearance times of the same data is large; and the same data appear at the closest distance, as compared with the SMF. Therefore, it is possible to effectively compress the data by the secondary code generator 400. Further, since the quantity of the primary code data can be fairly compressed, the primary codes 300 can be directly outputted.

In the secondary code generator 400, the output 300 of the primary code generator 200 are further compressed by the LZ method. The LZ method is widely used in the compression programs such as gzip, LHA, etc. In this method, the same data pattern is searched from the input data. When the same data pattern exists, the data quantity of the same data pattern is reduced by replacing the same data pattern with data (e.g., data related to the distance to the preceding same data pattern, the pattern length, etc.). For instance, in the data "ABCDEABCDEF", since "ABCDE" is repeated, "ABCDEABCDEF" is replaced with "ABCDE(5,5)F". Here, the compression code (5,5) represents "Turn back five letters and Copy five letters".

The processing will be described herein. The secondary code generator 500 shown in FIG. 14 shifts the processing position in sequence beginning from the head of the primary codes 300. When the data pattern at the processing position matches the data pattern within a previous constant area, the distance from the processing position to the data pattern and the length of the matched data pattern are both outputted as the secondary codes 500. Further, the processing position is shifted to an end of the second data pattern, to continue the similar processing. Here, if the data pattern at the processing position dose not matches the data pattern within the previous constant area, the primary code 300 are copied and then outputted as the secondary codes 500.

As understood by the above-mentioned description, the compression ratio can be increased with increasing data areas of the same data. Further, it is necessary that the distance between the same data areas is within a constant range. In a music as already explained, although the similar melody is repeatedly used, in the case of the original data of the SMF, the perfectly same data strings are not often repeated; in other words, a part of the data is often somewhat different from each other, for instance as follows: although the note numbers are the same but the velocities are different from each other.

On the other hand, according to the present invention, such processing is executed that the data of the same nature are collected and recorded at different areas, respectively; the same data in each area are processed so as to appear as often as possible; and the data of close nature are arranged at the closest possible areas. It is thus possible to increase the compression ratio by the LZ method, with the result that the capacity of the final secondary codes 500 can be reduced sufficiently. Further, in the above-mentioned formats and the processing procedure are all described only by way of example. Therefore, the formats and the procedure can be modified in various ways without departing the gist of the present invention. Further, although the SMF is explained as an example of the musical data, without being limited only to the SMF, the present invention can be applied to the other similar musical performance data, to effectively reduce the data capacity.

A musical performance data decoding apparatus for decoding the primary codes 300 and the secondary codes 500 as shown in FIG. 14 will be described hereinbelow.

Figure 31:
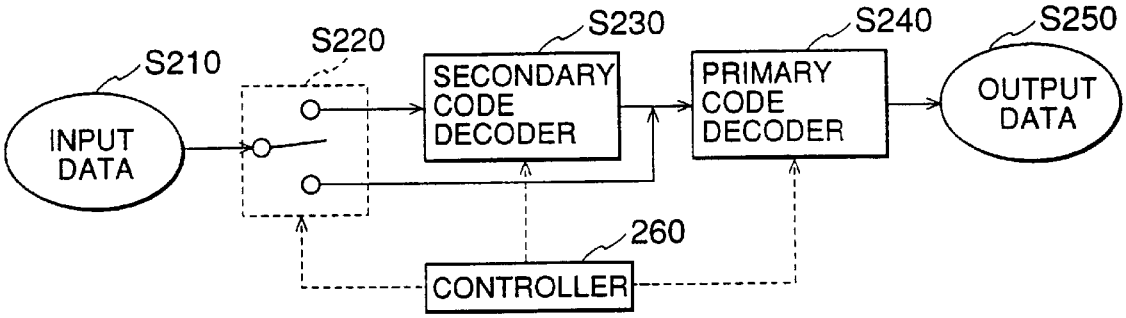
FIG. 31 is a block diagram showing the music performance data decoding apparatus.

In FIG. 31, in contrast with the compression processing, input data 210 compressed by the LZ method are separated into note numbers, sound velocities, sound durations, and other data, that is, the primary codes 300 by a secondary code decoder 230, and further restored to the original note (output data 250) by a primary code decoder 240. A controller 260 controls a switch 220 as follows: when the input data 210 are the secondary codes 500 as shown in FIG. 14, the secondary code decoding processing and the succeeding primary code decoding processing can be executed. Further, when the input data 210 are the primary codes 300 as shown in FIG. 14, only the primary code decoding processing can be executed.

Here, the discrimination as to whether the codes are the secondary codes 500 or the primary codes 300 can be executed by designating data indicative of the data sort through an input/output device (not shown) (e.g., a keyboard, mouse, display, etc.) operated by an operator or by adding data indicative of the sort of coding method to the compressed data so that the added data can be discriminated when decoded.

Figure 32:
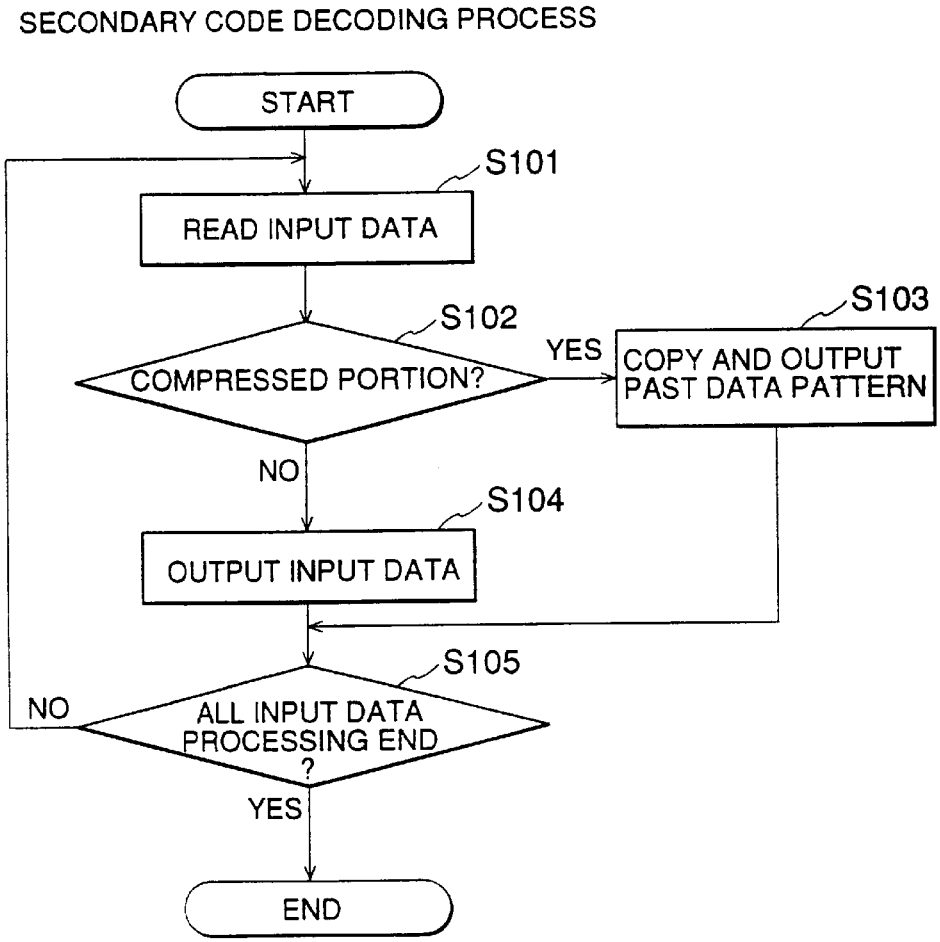
FIG. 32 is a flowchart for assistance in explaining the processing of the secondary code decoder shown in FIG. 31.

With reference to FIG. 32, the decoding processing by the secondary code decoder 23 will be described hereinbelow. First, the input data (the secondary codes 500) are read from the head thereof (in step s101). Then, it is discriminated whether the read data are the non-compressed data portion (e.g., [ABCDE] of ABCDE (5,5)) or the compressed data portion (e.g., (5,5) of ABCDE (5,5))(in step S102).

Further, in the case of the compressed data, the same pattern which appeared in the past is searched, copied and then outputted (in step S103). On the other hand, in the case of the non-compressed data, the data are outputted as they are (in step S104). After that, the above-mentioned processing is repeated unit all the input data (the secondary codes 500) can be decoded (in steps S105 to S101). As a result, it is possible to decode the primary codes 300 as arranged in FIG. 30.

Figure 33:
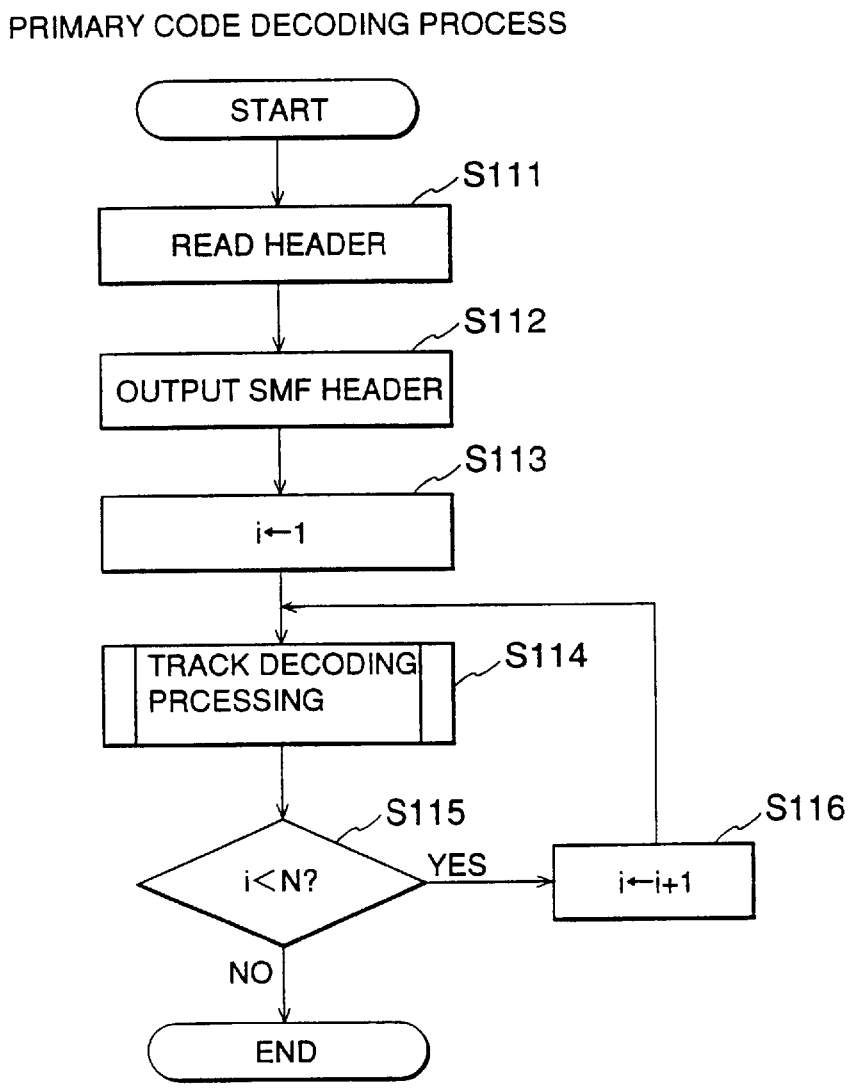
FIG. 33 is a detailed flowchart for assistance in explaining the processing of the primary code decoder shown in FIG. 31.

With reference to FIG. 33 and the primary codes 300 shown in FIG. 30, the decoding processing by the primary code decoder 240 shown in FIG. 31 will be explained hereinbelow. First, the heads of the primary codes 300 are read (in step S111). In the read headers, since various data such as the total track numbers N, the head addresses of the respective code areas from the note Δcode to the control code, the channel maps, time resolutions, etc. are recorded when coded, the SMF headers are formed on the basis of these head data and then outputted (in step S112).

Figure 34:
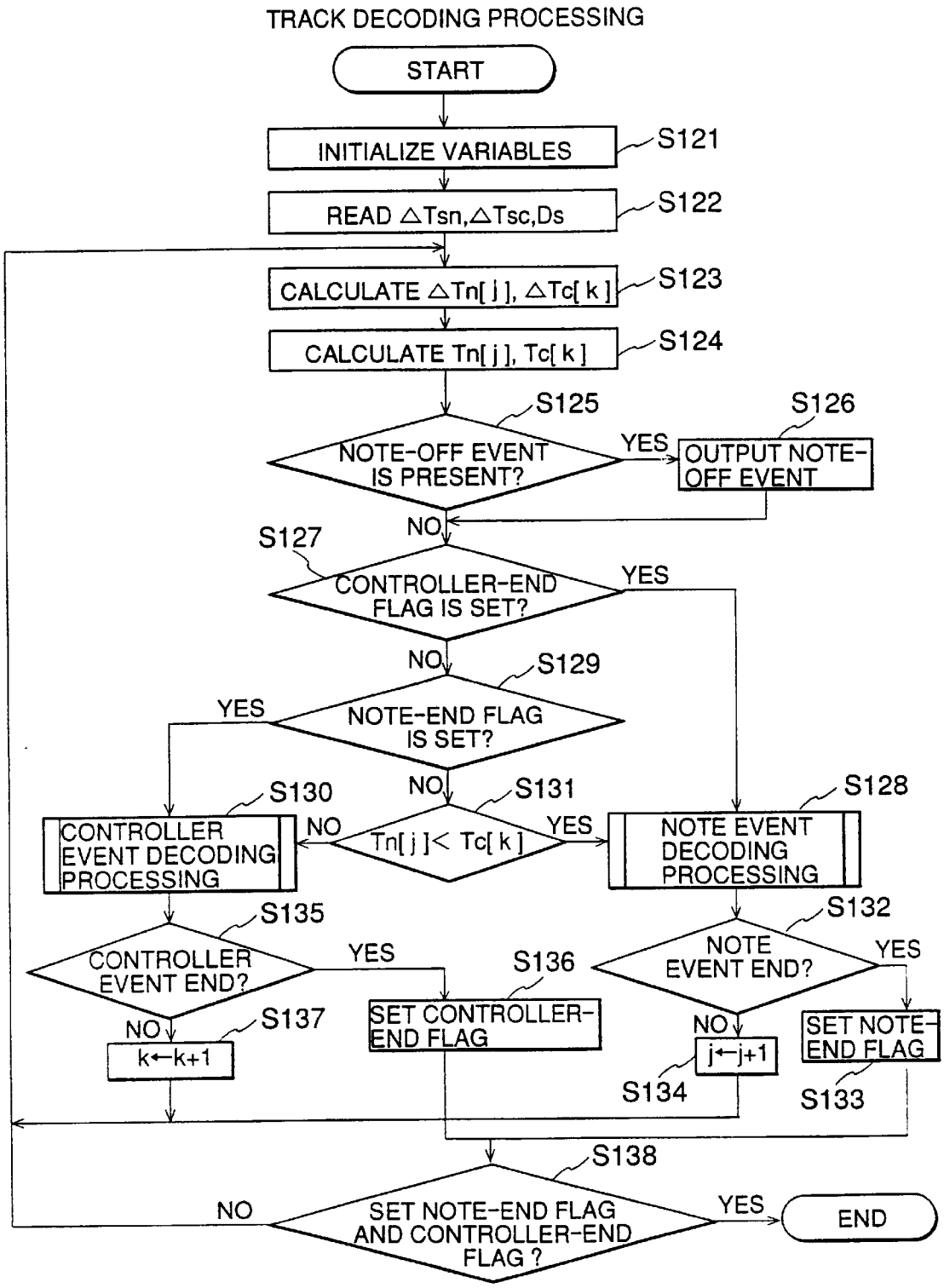
FIG. 34 is a detailed flowchart for assistance in explaining the processing of the track decoding processing shown in FIG. 33.

Further, the track number [i] is set to [1] (in step S113), and the track decoding processing as shown in FIG. 34 in detail is executed (in step S114). Further, the track number is checked as to whether the track number [i] is smaller than the total track number N (in step S115). If smaller than N, the track number [i] is incremented by one (in step S116), and returns to step S114 to repeat the track decoding processing. Further, in step S115, when the track number [i] is not smaller than the total track number N, the primary code decoding processing ends.

In the track decoding processing shown in FIG. 34 in detail, first the variables used for the processing are initialized (in step S121). In practice, the variable [j] indicative of the number of note event now being processed is set to [1]; the variable [k] indicative of the number of controller event now being processed is set also to [1], and the variable Tb indicative of the time at which immediately preceding event is output is set to [0]; and the note-end flag and the controller-end flag are both cleared. Here, the note-end flag indicates that all the note events of the processed tracks have been completed, and the controller-end flag indicates that all the controller events of the processed tracks have been completed.

Further, the greatest common divisor ΔTsn of the note Δcodes, the greatest common divisor ΔTsc of the controller Δcodes, and the greatest common divisor Ds of the duration codes of the processed track number [i] are all read (in step S122). Further, the j-th note Δcode ΔTan[j] and the k-th controller Δcode ΔTac[k] are read, and further multiplied by the greatest common divisors ΔTsn and ΔTsc, respectively to obtain ΔTn[j] and ΔTc[k] (in step S123) as follows:

$$\Delta Tn[j]=\Delta Tan[j]\times\Delta Tsn$$

$$\Delta Tc[k]=\Delta Tac[k]\times\Delta Tsc \quad (7)$$

Further, ΔTn[j] and ΔTc[k] are converted into the time Tn[j] and Tc[k] with the track head as its reference, respectively (in step S124) as follows:

$$Tn[j]=Tn[j-1]+\Delta Tn[j]$$

$$Tc[k]=Tc[k-1]+\Delta Tc[k] \quad (8)$$

where Tn[0]=Tc[0]=0

Further, in steps S123 and S124, when the note-end flag is set, ΔTn[j] and Tn[j] are not calculated. Further, when the controller-end flag is set, ΔTc[k] and Tc[k] are not calculated.

Figures 35, 36:
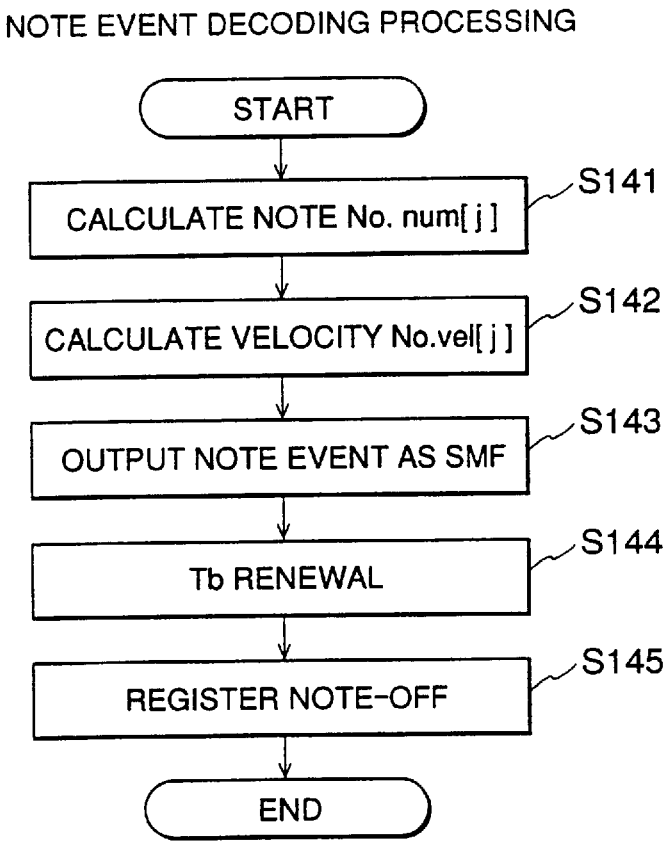
FIG. 35 is a detailed flowchart for assistance in explaining the processing of the note event decoding processing shown in FIG. 34.
FIG. 36 is an illustration showing the note-on event decoded by the note event decoding processing shown in FIG. 35.
Figures 37, 38:
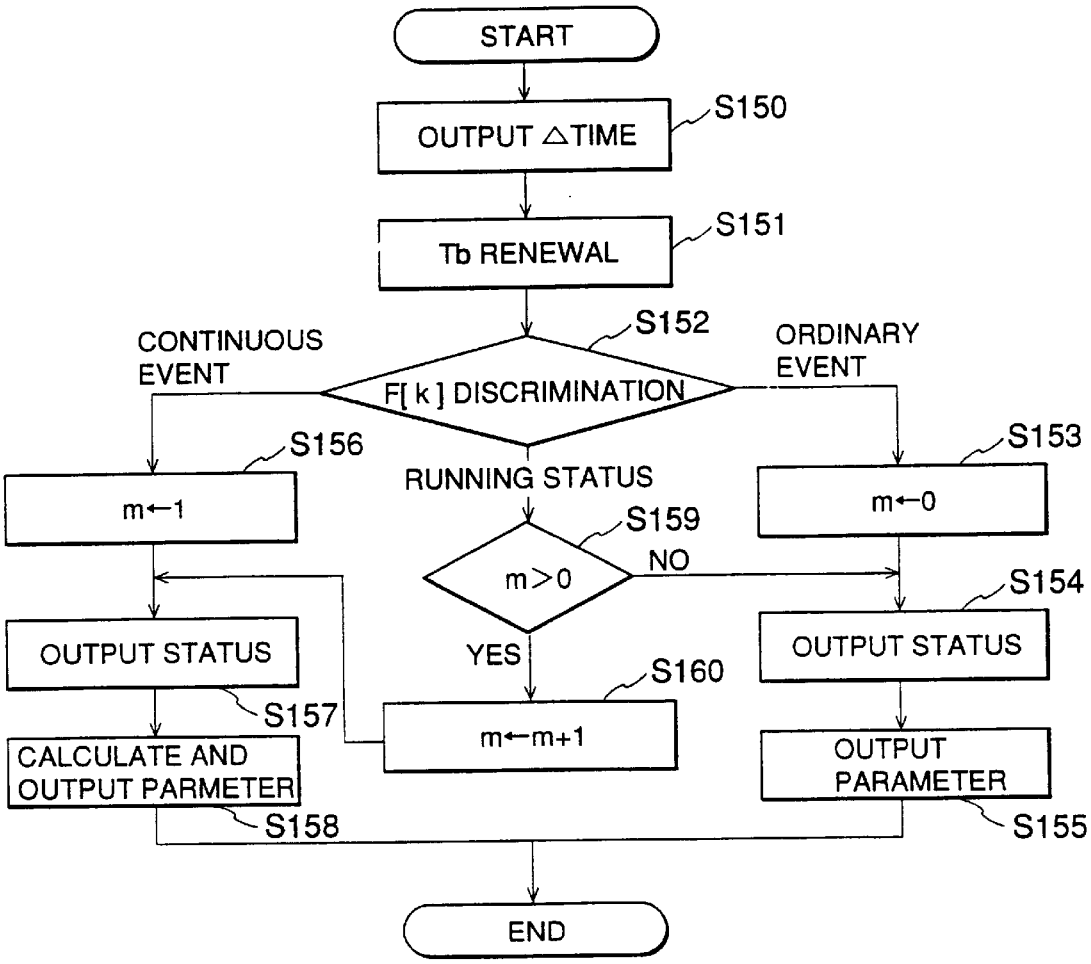
FIG. 37 is an illustration showing a note-off queue decoded by the note event decoding processing shown in FIG. 35.
FIG. 38 is a detailed flowchart for assistance in explaining the controller event decoding processing shown in FIG. 34.

Further, the presence or absence of the note-off event to be outputted is checked (in step S125). In the case of presence of the data to be outputted, the note-off even is outputted as the SMF (in step S126). Further, the steps S125 and S126 are both described in further detail, later (in step S144 of FIG. 35). Further, decoding processing is selected. First, the controller-end flag is checked (in step S127). When the controller-end flag is set, the note event decoding processing as described later in detail with reference to FIG. 35 is executed (in step S128). When the controller-end flag is not set, note-end flag is checked (in step S129). When this note-end flag is set, the controller event decoding processing as described later in detail with reference to FIG. 38 is executed (in step S130). When both the flags are not set, Tn[j] and Tc[k] are compared with each other (in step S131). When Tn[j] is smaller than Tc[k], the note event decoding processing is executed (in step S128). When Tn[j] is not smaller than Tc[k], the controller event decoding processing is executed (in step S130).

After the note event decoding processing, it is checked whether all the note events of the preceding track [i] have been processed (in step S132). If the processing ends, the note-end flag is set (in step S133), and procedure proceeds to step S138. If not so, the variable [j] is incremented by one (in step S134), returning to step S123. Further, after the decoding processing of the controller events, it is checked whether all the controller events of the preceding track [i] have been processed (in step S135). If the processing ends, the controller-end flag is set (in step S136), and procedure proceeds to step S138. If not so, the variable [k] is incremented by one (in step S137), returning to step S123.

In step S138, it is checked whether both the note-end flag and the controller-end flag are set. If both the flags are set, the track decoding processing for the present track ends. If not so, the procedure returns to step S123, to repeat the above track decoding processing.

In the note-event decoding processing as shown in detail in FIG. 35, first the j-th note number code α[j] is read, and the note number num[j] is calculated by use of the function f() the same as used in the compression processing and in accordance with the following formula (9) (in step S141).

$$\text{num}[j]=f(\text{num}[j-1], \text{num}[j-2], \ldots, \text{num}[j-S])+\alpha[j] \quad (j>S)$$

$$\text{num}[j]=\alpha[j] \quad (j\leqq S) \quad (9)$$

where S is the number of variables of the function f().

In the same way as above, the j-th velocity code β[j] is read, and the velocity vel[j] is calculated by use of the function g() the same as used in the compression processing and in accordance with the following formula (10) (in step S142).

$$\text{vel}[j]=g(\text{vel}[j-1], \text{vel}[j-2], \ldots, \text{vel}[j-S])+\beta[j] \quad (j>T)$$

$$\text{vel}[j]=\beta[j] \quad (j\leqq T) \quad (10)$$

where T is the number of variables of the function g().

Further, on the basis of the Tn[j], num[j] and vel[j], a note-on event as shown in FIG. 36 is outputted (in step S143). Further, the Δtime ΔT of the SMF is obtained by use of the time Tb of the event immediately before Tn[j] in accordance with the following formula (11), and then outputted.

$$\Delta T=Tn[j]-Tb \quad (11)$$

In the note-on event shown in FIG. 36, the higher four bits of the status byte represents the note-on [9(hex)], and the lower four bits represents the number obtained by the channel map. Further, the bytes of the note number and the velocity follow this status byte. Further, the time Tb is rewritten to Tn[j] for renewal (in step 144).

Further, in FIG. 35, the note-off event is registered (in step S145). In practice, the duration code Da[j] is read; the time Toff of the note-off event is calculated in accordance with the following formula (12); and the time Toff and the note number num[j] are registered in the note-off queue as shown in FIG. 37.

$$Toff[j]=Da[j]\times Ds+Tn[j] \quad (12)$$

In this note-off queue, the number of entries now being used is held, and further the note-off time Toff is managed so as to be arranged in order beginning form the smallest one.

In the step S125 as shown in FIG. 34, the value Tm, which is the smaller between Tn[j] and Tc[k], is compared in sequence with the head Toff[n] (n=1 to N, N: the total number of entries) of the note-off queue. If there exists an entry such as Toff[n] <Tm, procedure proceeds to step S126, to output the note-off event. In step S126, after ΔT is calculated according to the following formula (13) and output, Tb is rewritten to Toff[n] for renewal, and the above-mentioned note-off event is outputted as the SMF.

$$\Delta T=Toff[n]-Tb \quad (13)$$

The controller event decoding processing will be described in detail hereinbelow with reference to FIG. 38. In this processing, the controller event composed of the Δtime, status and parameter as shown in FIG. 39 is decoded. First, Δtime ΔT is obtained by use of the time Tb of the event outputted immediately before Tc[k] in accordance with the following formula (14) (in step S150).

$$\Delta T=Tc[k]-Tb \quad (14)$$

Tb is rewritten to Tc[k] for renewal (in step S151).

Then, the event flag F[k] indicative of the sort of the events is read from the controller code area, and it is discriminated whether the F[k] is the [ordinary event] or [continuous event] or [running status] (in step S152). Here, [running status] is a status in which the flag F[k] is omitted while the parameter (data bytes) of an event is directly written. It is easy to detect [running status because the codes are assigned to the flag F and the parameter (data bytes) to discriminate therebetween. The status in which the flag F[k] is omitted and does not exist is expressed as "F[k] is [running status]" hereinafter. Here, in the continuous event block, as shown in FIG. 28, the second and after events are recorded under [running status].

If the F[k] is [ordinary event], the variable [m] indicative of the order in the continuous block of the processed event is reset to [0] (in step S153), and then the status byte of the SMF is formed with reference to the channel map, and the formed channel map is outputted (in step S154). Further, the number of bytes necessary for the sort of the events is read from the controller code area, and the read byte value is outputted as the parameter (data bytes) of the SMF (in step S155).

If the F[k] is [continuous event], the variable [m] indicative of the order in the continuous block of the processed event is set to [1] (in step S156), and then the status byte of the SMF is formed with reference to the channel map, and the formed channel map is outputted (in step S157). Further, when m≧2, the status bytes obtained when m=[1] is used as the status bytes of m≧2. Further, in the case of [continuous event], the parameter code γ[m] is read, and the parameter p[m] is formed by use of the function h() the same as used for the compression processing and in accordance with the following formula (15), and the formed parameter is outputted (in step S158).

$$p[m]=h(p[m-1], p[m-2], \ldots, p[m-U])+\gamma[m] \quad (m>U)$$

$$p[m]=\gamma[m] \quad (m\leqq U) \qquad (15)$$

where U is the number of variables of the function h().

Further, when F[k] is [running status], the number of the variables [m] is checked (in step S159). If [m] is larger than [0], [m] is incremented by one because it is the second or after event in the continuous event block (in step S160), and procedure proceeds to step S157 on the side of [continuous event]. On the other hand, if [m] is [0], procedure proceeds to step S154 on the side of [ordinary event].

As described above, in the musical data recording method and the musical data reproducing apparatus according to the present invention, the following excellent effects can be obtained.

The musical data such as the note data are distinguished according to the sorts of data and then recorded in independent areas respectively. It is thus possible to collect data in such a way that the probability of appearance of the same data pattern can be increased.

Therefore, when the musical data file is compressed in accordance with the pattern matching method, it is possible to increase the data compression efficiency markedly, and thereby when the compressed data are stored in a storage medium or transmitted through a transmission line, the capacity of the compressed data can be reduced markedly. As a result, a storage medium of small capacity can be used. In addition, since the service time of the transmission line can be reduced, it is possible to economize the rental fee of the transmission line.

Further, in the musical data reproducing apparatus according to the present invention, it is possible to reproduce music from the file obtained by compressing the musical data as described above. In addition, it is possible to reduce the capacity of the file storage medium for recording the compressed file.

Further, in the musical data compressing and decoding apparatus according to the present invention, before the musical data are compressed in accordance with the LZ method, the musical data are previously separated into note numbers, velocities, and other data in such a way that the length of the same data pastern can be lengthened; the number of appearances of the same data pattern can be increased; and the appearance distance of the same data pattern can be shortened. Further, the respective musical data are arranged in the independent areas, respectively so as to form the primary codes, and the formed primary codes are compressed in accordance with the LZ method. As a result, it is possible to compress the musical data effectively.

Further, the musical data of the primary codes are divided into at least four areas of note number area, the note velocity area, note duration area, and the other area, for coding. Therefore, it is possible to reduce the data capacity markedly without losing the musical performance quality of the original musical data. As a result, a storage medium of small capacity can be used to record the musical data, so that cost of the storage medium can be reduced. Further, when musical data are transmitted through a transmission line, since the transmission time can be reduced, the transmission cost can be economized. The method and apparatus according to the present invention is particularly effective when applied to a system using a large quantity of musical data such as musical data base, communication accompanying apparatus.

What is claimed is:

1. A method of recording a file of sequential musical performance data each including time data, note data indicative of a note and music sound start or music sound stop of the note at a moment indicated by the time data, and accent data indicative of sound velocity, comprising the steps of:

sequentially reading the musical performance data;

recording the time data, the note, and either the music sound start or the music sound stop in a first recording area in accordance with the time data;

recording all the accent data included in the sequential musical performance data in a second recording area, the second recording area being separated from the first recording area;

combining the recorded data in the first and second areas to obtain another file; and recording the another file in a recording medium.

2. The method according to claim 1, wherein the file consists of a plurality of musical performance data each including the time, note, and accent data, and another plurality of musical performance data each including control data, further comprising the steps of:

determining, by use of discrimination data added to the control data, whether the musical performance data thus read includes the control data;

when the determining is made, recording the control data in a third recording area, the third recording area being separated from the first and second recording areas; and combining the recorded data in the first, second, and third areas to obtain the another file.

3. An apparatus for reproducing compressed sequential musical performance data, comprising:

decoding means for decoding the compressed sequential musical performance data stored in a first storage medium, each musical performance data including time data, note data indicative of music sound start and music sound stop at a moment indicated by the time data, accent data indicative of sound velocity, and control data, all the note data, all the accent data, and all the control data included in the compressed sequential musical performance data being recorded in a first, a second, and a third recording area separated from each other in the first storage medium;

a second storage medium that temporarily stores the decoded sequential musical performance data;

control means for controlling reproduction of the decoded sequential musical performance data temporarily stored in the second storage medium such that the note and accent data are reproduced before the control data; and a sound source that reproduces the sequential musical performance data thus controlled by the control means and generates music sounds in accordance with the reproduced sequential musical performance data.

4. An apparatus for compressing sequential musical performance data, comprising:

separating means for separating the musical performance data into at least note number data, sound velocity data, sound duration data, and control data, the separated data including respective information which is the same among the sequential musical performance data; and compressing means for compressing each of the separated data to form compressed musical performance data.

5. The apparatus according to claim 4, wherein the compressing means compresses the separated data by the Lempel-Zif method.

6. The apparatus according to claim 4, wherein the separating means comprises means for calculating a common divisor of relative times among the sequential musical performance data and means for dividing the relative times by the common divisor to generate compressed musical performance data.

7. The apparatus according to claim 4, wherein the separating means comprises means for calculating durations, each duration being between a start of a note and an end of the note, calculating a common divisor of the durations, and dividing the durations by the common divisor to generate compressed musical performance data.

8. The apparatus according to claim 4, wherein the separating means comprises means for forming a code of at least any one of the note number data, sound velocity data, and control data, the code being expressed by means of a difference between a data obtained by a function of the one of the note number data, sound velocity data, and control data and the one of the data.

9. The apparatus according to claim 4, wherein the separating means comprises means for forming a code in which the note number data, sound velocity data, sound duration data, and control data are arranged in a specific order such that data of same nature are arranged close to each other.

10. An apparatus for decoding compressed sequential musical performance data, comprising:

first decoding means for decoding the musical performance data compressed by the Lempel-Zif method; and second decoding means for decoding the musical performance data thus decoded b the first decoding means to reproduce at least note number data, sound velocity data, sound duration data, and control data, the separated data including respective information which is the same among the sequential musical performance data.

11. The apparatus according to claim 10, further comprising means for determining, by use of discrimination data added to each compressed musical performance data, whether the musical performance data is data compressed by the Lempel-Zif method and, if so, supplying the musical performance data to the first decoding means, whereas, if not, then supplying the musical performance data directly to the second decoding means to reproduce at least the note number data, the sound velocity data, the sound duration data, and the control data.

* * * * *